US009436156B1

(12) United States Patent
Hattori et al.

(10) Patent No.: US 9,436,156 B1
(45) Date of Patent: Sep. 6, 2016

(54) DEVELOPING DEVICE AND IMAGE FORMING APPARATUS

(71) Applicant: FUJI XEROX CO., LTD., Tokyo (JP)

(72) Inventors: Ryuji Hattori, Yokohama (JP); Shota Makita, Yokohama (JP); Katsuyuki Nishizawa, Yokohama (JP); Kazuya Nishimura, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/863,878

(22) Filed: Sep. 24, 2015

(30) Foreign Application Priority Data

Mar. 13, 2015 (JP) ..... 2015-050189

(51) Int. Cl.
*G03G 21/16* (2006.01)

(52) U.S. Cl.
CPC ..... *G03G 21/1676* (2013.01)

(58) Field of Classification Search
CPC ..... G03G 21/1676; G03G 15/0822; G03G 21/1832
See application file for complete search history.

(56) References Cited

U.S. PATENT DOCUMENTS

2002/0085857 A1* 7/2002 Kim ..... G03G 21/1832 399/119
2012/0263503 A1* 10/2012 Nagashima ..... G03G 15/0877 399/262
2013/0195511 A1* 8/2013 Eto ..... G03G 15/0877 399/260

FOREIGN PATENT DOCUMENTS

JP 2009-115885 A 5/2009

* cited by examiner

*Primary Examiner* — Sandra Brase
(74) *Attorney, Agent, or Firm* — Oliff PLC

(57) ABSTRACT

A developing device includes a housing that includes an accommodating portion, a development opening portion, a developing roller, and a supply receiving portion; an opening/closing member; a guiding portion; and an elastic pushing member. The opening/closing member includes a body, a guide portion, and an extended protrusion, the body having a cutaway end portion, the guide portion being provided at left and right end portions of the body except where the cutaway end portion exists, the extended protrusion being formed by causing at least a portion of an end portion of the body to extend and protrude in an opening direction. The housing is provided with a sandwiching holding portion that holds at least a portion of the extended protrusion of the opening/closing member by sandwiching at least the portion of the extended protrusion by the sandwiching holding portion and the supply receiving portion.

9 Claims, 14 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-050189 filed Mar. 13, 2015.

BACKGROUND (i) Technical Field

The present invention relates to a developing device and an image forming apparatus.

(ii) Related Art

In an image forming apparatus that forms an image that is formed with developer, for example, a structure that supplies new developer as supply developer from a developer container to a developing device is used. When the developer container or the developing device is mounted on or dismounted from a body of the image forming apparatus, the developing device and a developer supplying device along with the developer container have a structure for connecting the developer container and the developer supplying device with each other during the mounting and the dismounting thereof, or a structure for connecting the developing device and the developer supplying device with each other during the mounting and the dismounting thereof.

SUMMARY

According to an aspect of the invention, there is provided a developing device including a housing that includes an accommodating portion that accommodates developer, a development opening portion that is formed continuously with the accommodating portion, a developing roller that is rotatably disposed at a side of the accommodating portion with respect to the opening portion, and a supply receiving portion having a receiving opening that receives supply developer that is supplied to the accommodating portion; an opening/closing member that is mounted on the supply receiving portion of the housing, the opening/closing member moving between a position where the receiving opening is uncovered and a position where the receiving opening is covered; a guiding portion that is provided at the supply receiving portion of the housing, the guiding portion guiding movement of the opening/closing member; and an elastic pushing member that pushes the opening/closing member towards the position where the receiving opening is covered. The opening/closing member includes a body, a guide portion, and an extended protrusion, the body having a cutaway end portion that is formed by cutting away a corner located at one of left and right end portions, the left and right end portions corresponding to left and right sides when the opening/closing member moves between the position where the receiving opening is uncovered and the position where the receiving opening is covered, the guide portion being provided at the left and right end portions of the body except where the cutaway end portion exists, the guide portion being guided by contacting the guiding portion so as to surround the guiding portion from an outer side thereof, the extended protrusion being formed by causing at least a portion of an end portion of the body to extend and protrude in an opening direction when the opening/closing member moves to the position where the receiving opening is uncovered, the end portion corresponding to a leading side in the opening direction. The housing is provided with a sandwiching holding portion that holds at least a portion of the extended protrusion of the opening/closing member by sandwiching at least the portion of the extended protrusion by the sandwiching holding portion and the supply receiving portion.

BRIEF DESCRIPTION OF THE DRAWINGS

Exemplary embodiments of the present invention will be described in detail based on the following figures, wherein.

DETAILED DESCRIPTION

An exemplary embodiment for carrying out the invention (hereunder simply referred to as "exemplary embodiment") is hereunder described with reference to the attached drawings.

First Exemplary Embodiment

FIGS. 1 to 4 illustrate an image forming apparatus 1 according to a first exemplary embodiment.

Figure 1:
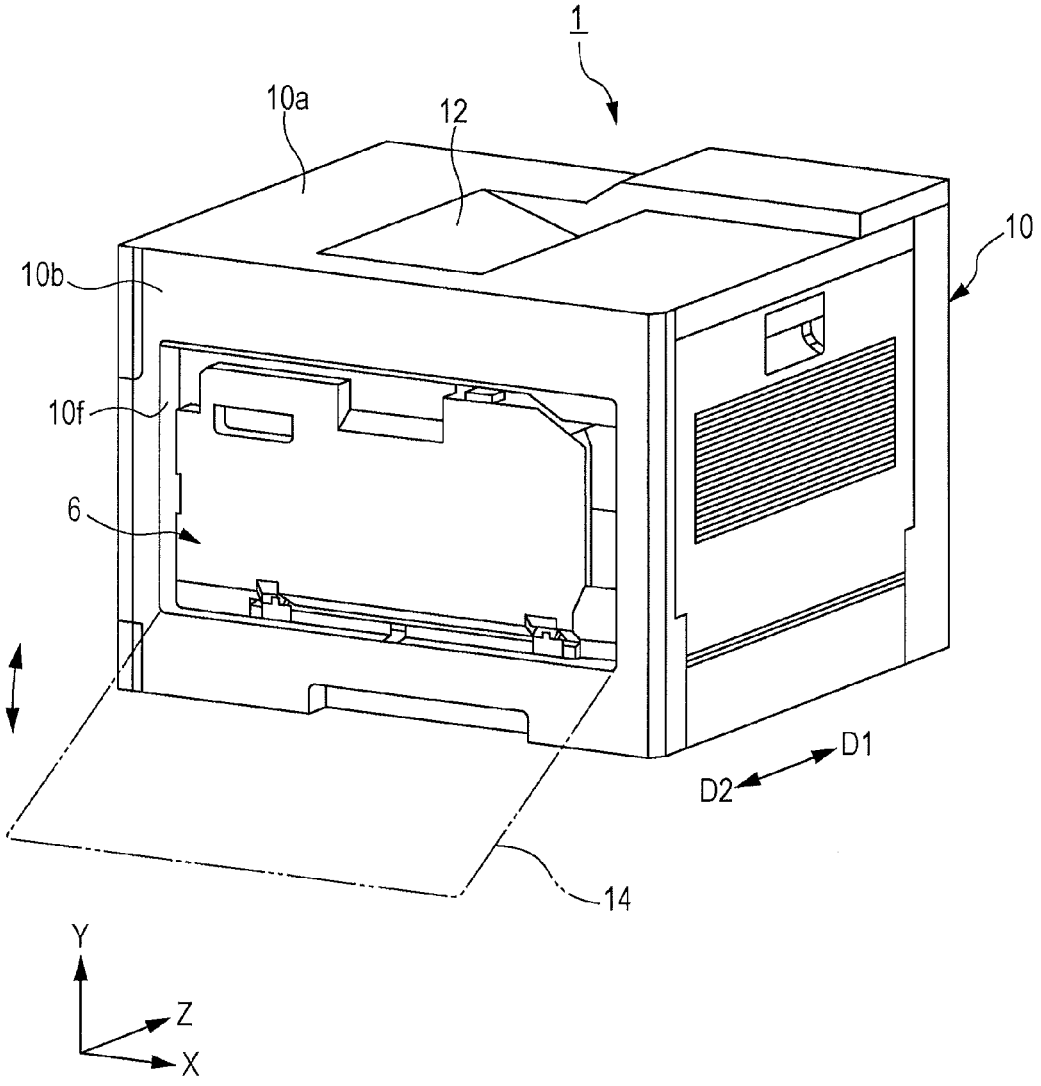
FIG. 1 is a perspective view of an exterior of an image forming apparatus according to a first exemplary embodiment (exterior of the image forming apparatus in which an exterior cover is open)
Figure 2:
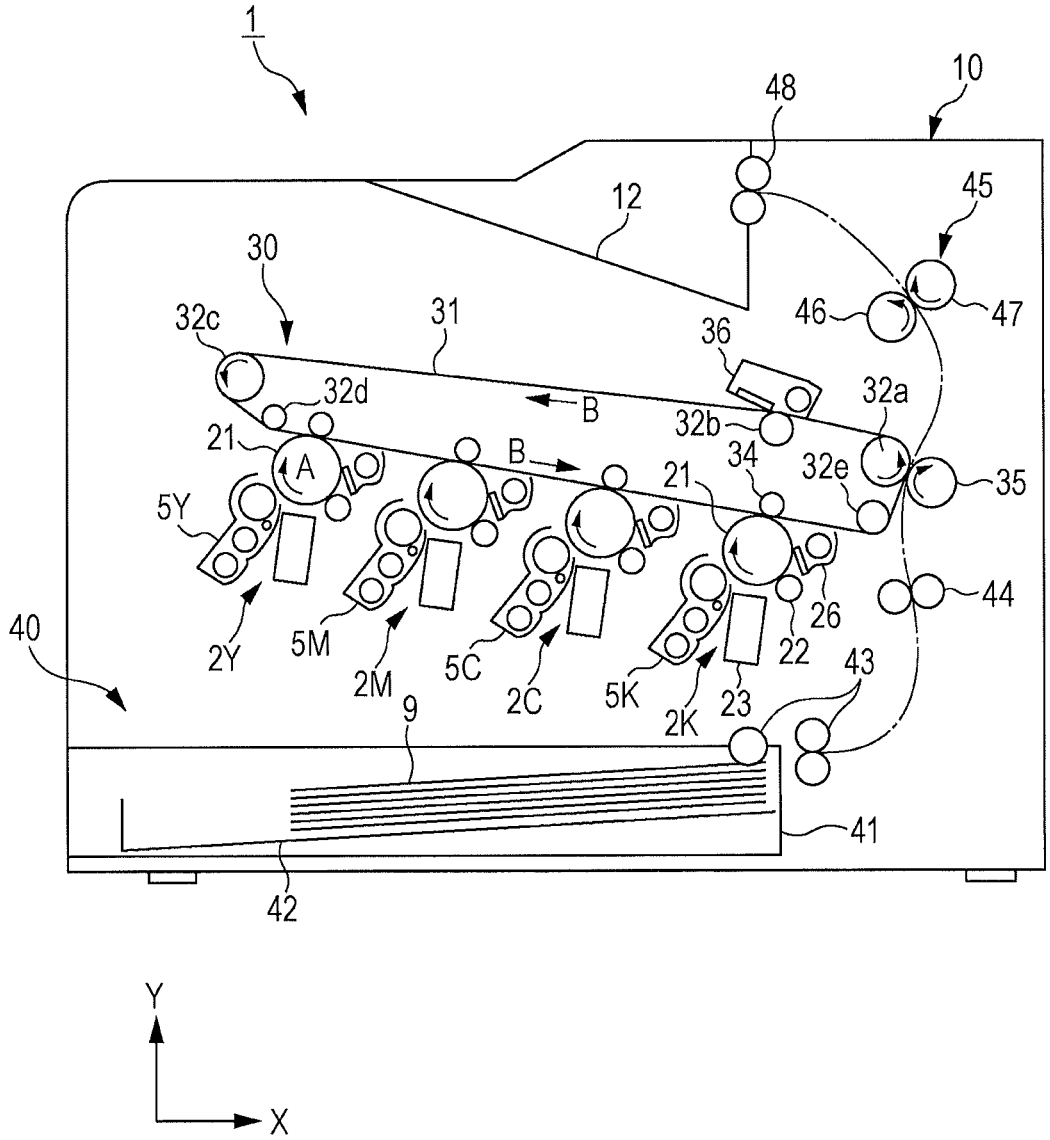
FIG. 2 is a general view of a structure of an interior of the image forming apparatus shown in FIG. 1.
Figure 3:
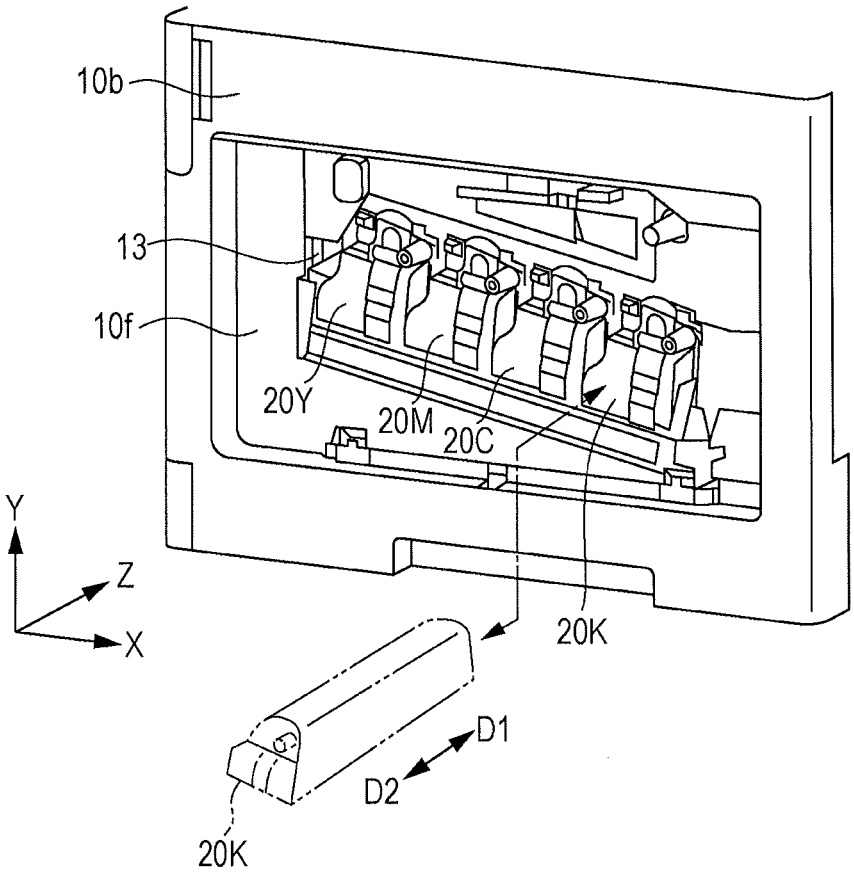
FIG. 3 is a perspective view illustrating part of each removable unit and partly illustrating a state of a mounting portion thereof in the image forming apparatus shown in FIG. 1.
Figure 4:
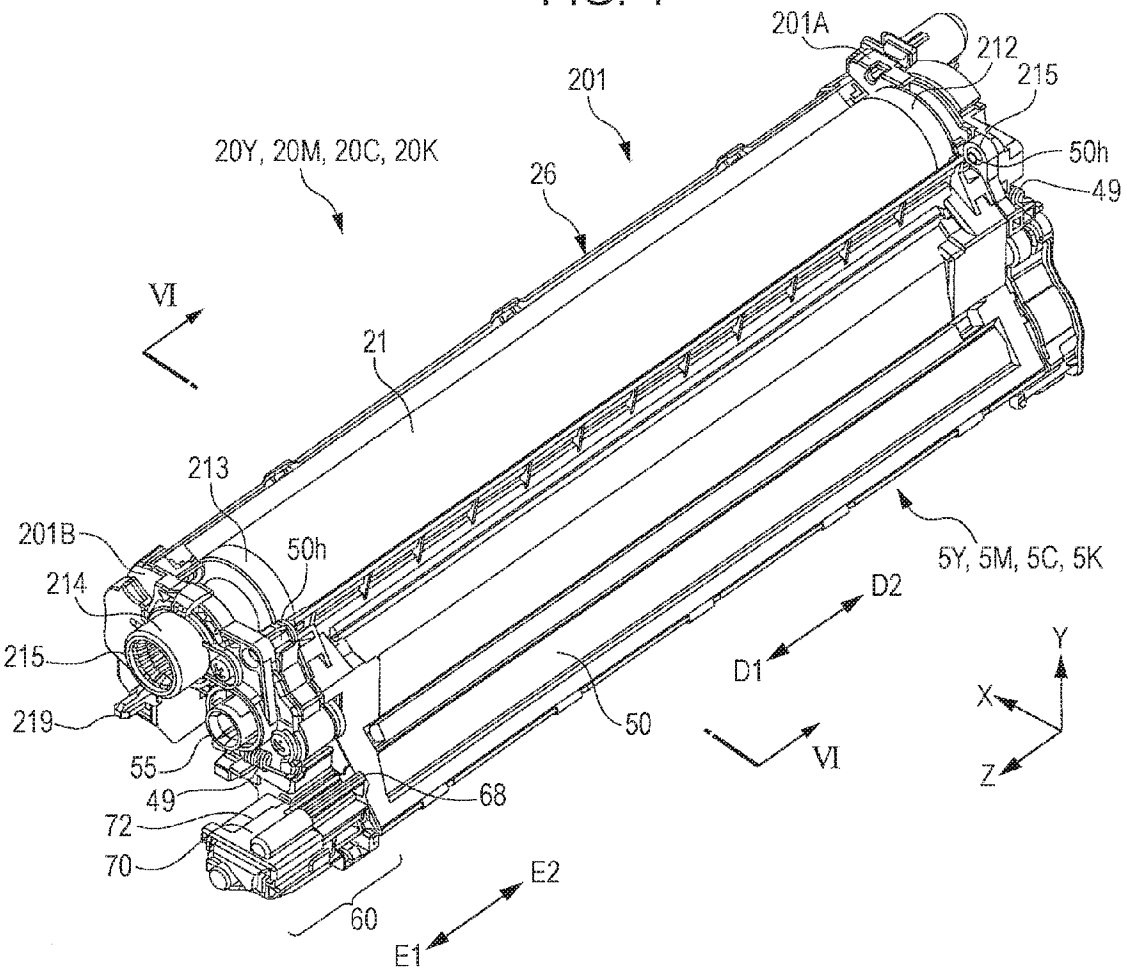
FIG. 4 is a perspective view illustrating a state of a removable unit including a developing device according to the first exemplary embodiment when seen from a side of an end portion corresponding to a far side when each removable unit is mounted.

FIG. 1 illustrates an exterior of the image forming apparatus 1 (exterior in which an exterior cover 14 is open. FIG. 2 illustrates a structure of an interior of the image forming apparatus 1. FIG. 3 partly illustrates a state in which image forming devices 2 are exposed as a result of removal of developer recovering containers of the image forming apparatus 1. FIG. 4 illustrates a removable unit that includes a developing device according to the first exemplary embodiment and that is capable of being mounted on and dismounted from the image forming apparatus 1. In each of the figures, such as FIG. 1, arrows X, Y, and Z correspond to (directions of) orthogonal coordinate axes in respective width, height, and depth directions in three-dimensional space in each of the figures.

Overall Structure of Image Forming Apparatus

The image forming apparatus 1 according to the first exemplary embodiment forms an image, formed with developer, on recording paper 9, which is an exemplary recording medium; and is, for example, a printer that forms an image as a result of receiving image information that is input from an external device, such as an information terminal device.

The image forming apparatus 1 includes a housing 10 whose entire exterior has the shape of a box. As shown in FIG. 2, for example, the image forming devices 2, an intermediate transfer device 30, a sheet-feeding device 40, and a fixing device 45 are disposed in an internal space of the housing 10. Each image forming device 2 forms a toner image formed with toner serving as developer. The intermediate transfer device 30 which, after the toner images formed by the image forming devices 2 have been first-transferred to and held by the intermediate transfer device 30, transports and finally second-transfers the first-transferred images to recording paper 9. The sheet-feeding device 40 accommodates and sends out recording paper 9 that is supplied to a second transfer position of the intermediate transfer device 30. The fixing device 45 fixes the toner images second-transferred by the intermediate transfer device 30 to the recording paper 9. A discharge accommodating unit 12 to which pieces of recording paper 9 on which images have been formed are discharged and that accommodates such pieces of recording paper in a stacked state is formed at a top surface portion 10*a* of the housing 10. A dot-and-dash line shown in FIG. 2 indicates a main transport path of recording paper 9.

The image forming devices 2 correspond to four image forming devices 2Y, 2M, 2C, and 2K that separately form developer (toner) images of respective four colors, that is, yellow (Y), magenta (M), cyan (C), and black (K). The image forming device 2Y, 2M, 2C, and 2K according to the first exemplary embodiment are disposed in an oblique state with gradually increasing height in the order of the image forming device 2K for black, the image forming device 2C for cyan, the image forming device 2M for magenta, and the image forming device 2Y for yellow in the internal space of the housing 10.

The four image forming devices 2Y, 2M, 2C, and 2K each include, for example, a photoconductor drum 21, a charging device 22, a exposure device 23, a corresponding one of developing devices 5Y, 5M, 5C, and 5K, and a drum cleaning device 26. Each photoconductor drum 21 is rotationally driven in the direction of arrow A. Each charging device 22, which is, for example, a roller, charges an image formation surface at an outer peripheral surface of the corresponding photoconductor drum 21 to a required potential. Each exposure device 23 forms an electrostatic latent image of a corresponding color component by irradiating the charged image formation surface of the corresponding photoconductor drum 21 with light whose color components have been separated on the basis of required image information. Each of the developing devices 5Y, 5M, 5C, and 5K renders visible the corresponding electrostatic latent image as a toner image of the corresponding color by developing the corresponding electrostatic latent image by supplying toner of the corresponding color component. Each drum cleaning device 26 removes and cleans off any undesired substances, such as toner, remaining on the outer peripheral surface of the corresponding photoconductor drum 21 after first-transferring the toner image on the corresponding photoconductor drum 21 to (an intermediate transfer belt 31) of the intermediate transfer device 30.

Referring to, for example, FIG. 4, each of the image forming devices 2Y, 2M, 2C, and 2K is such that its photoconductor drum 21, its charging device 22, the corresponding one of the developing devices 5Y, 5M, 5C, and 5K, and its drum cleaning device 26, which are some of the structural components, are supported by a common supporting frame 201 and are integrated with each other. Each of the image forming devices 2Y, 2M, 2C, and 2K as a whole is formed as a unit structure (removable unit 20) that is removably mounted on a mounting portion 13 that is provided at the housing 10 of the image forming apparatus 1. Incidentally, a line LED array which includes a combination of various optical components or multiple light emitting diodes (LED) may be used as each of the exposure devices 23 of the corresponding image forming device 2. The exposure devices 23 are previously disposed at required portions of the respective mounting portions 13.

The removable units 20Y, 20M, 20C, and 20K and the developing devices 5 forming part of the corresponding units 20 are described in more detail later.

When each of the image forming devices 2Y, 2M, 2C, and 2K receives a request for forming an image, each charging device 22 charges the outer peripheral surface of the corresponding photoconductor drum 21 that has started rotating to a required potential, after which the charged outer peripheral surface of the corresponding photoconductor drum 21 is irradiated with light in accordance with an image signal of the corresponding color component from the corresponding exposure device 23, so that an electrostatic latent image of the corresponding color component is formed. Next, each electrostatic latent image of the corresponding color component formed on the outer peripheral surface of the corresponding photoconductor drum 21 is developed with toner of the corresponding one of the four colors (Y, M, C, and K) by the corresponding developing device 5, so that the toner images of the four colors are formed on the respective photoconductor drums 21.

The intermediate transfer device 30 is disposed in a slightly oblique state in correspondence with the oblique arrangement of the group of image forming devices 2 at a location above the image forming devices 2Y, 2M, 2C, and 2K in a center-of-gravity direction.

The intermediate transfer device 30 includes the intermediate transfer belt 31, multiple support rollers 32*a* to 32*e*, first transfer devices 34, a second transfer device 35, and a belt cleaning device 36. The intermediate transfer belt 31 is an endless transfer belt. The toner images on the photoconductor drums 21 of the respective image forming devices 2Y, 2M, 2C, and 2K that have been first-transferred to the intermediate transfer device 30 are held by the intermediate transfer device, after which the intermediate transfer device 30 is capable of transporting the toner images. The multiple support rollers 32*a* to 32*e* support the intermediate transfer belt 31 such that the intermediate transfer belt 31 rotates in the direction of arrow B by successively passing first transfer positions of the respective image forming devices 2Y, 2M, 2C, and 2K. The first transfer devices 34, which are, for example, rollers, are disposed at the inner side of the intermediate transfer belt 31 and first-transfers the toner images that are formed on the photoconductor drums 21 of the respective image forming devices 2Y, 2M, 2C, and 2K to an outer peripheral surface of the intermediate transfer belt 31. The second transfer device 35, which is, for example, a roller, second-transfers the toner images first-transferred to the intermediate transfer belt 31 to recording paper 9. The belt cleaning device 36 removes any undesired substances, such as toner, remaining on the outer peripheral surface of the intermediate transfer belt 31 after the second transfer.

Of these, the support roller 32*a* is a driving roller and a second transfer backup roller, the support roller 32*b* is a cleaning backup roller, the support roller 32*c* is a tension applying roller, and the support rollers 32*d* and 32*e* are flattening rollers.

The sheet-feeding device 40 is disposed below the image forming devices 2Y, 2M, 2C, and 2K in the center-of-gravity direction.

The sheet-feeding device 40 includes a sheet accommodating member 41 and a send-out device 43. The sheet accommodating member 41 is mounted such that it is capable of being drawn out from the housing 10. The sheet accommodating member 41 accommodates pieces of recording paper 9 of, for example, desired sizes and types that are stacked on a stacking plate 42. The send-out device 43 sends out the pieces of recording paper one at a time from the sheet accommodating member 41. In the sheet-feeding device 40, when images are to be formed, required pieces of recording paper 9 are sent out one at a time from the sheet accommodating member 41 by the send-out device 43. The pieces of recording paper 9 that have been sent out from the sheet-feeding device 40 move forward along the transport path indicated by the dot-and-dash line. A pair of transport timing adjusting rollers 44 disposed at the transport path finally sends the pieces of recording paper 9 to the second transfer position of the intermediate transfer device 30 (where the second transfer device 35 is in contact with the intermediate transfer belt 31) in accordance with a second transfer timing.

In the intermediate transfer device 30, when images are to be formed, the first transfer devices 34 successively first-transfer toner images of respective colors that are formed by the respective image forming devices 2Y, 2M, 2C, and 2K while the toner images are positioned at the outer peripheral surface of the intermediate transfer belt 31. At this time, at the image forming devices 2Y, 2M, 2C, and 2K, the outer peripheral surfaces of the respective photoconductor drums 21 after the first transfer are cleaned by the respective drum cleaning devices 26. Next, the intermediate transfer belt 31 transports the first-transferred toner images to the second transfer position that opposes the second transfer device 35. Thereafter, in the intermediate transfer device 30, the second transfer device 35 second-transfers the toner images on the intermediate transfer belt 31 to a piece of recording paper 9 supplied up to the second transfer position from the sheet-feeding device 40. At this time, in the intermediate transfer device 30, the outer peripheral surface of the intermediate transfer belt 31 after the second transfer is cleaned by the belt cleaning device 36.

The fixing device 45 is disposed above the second transfer position of the intermediate transfer device 30 in the center-of-gravity direction.

The fixing device 45 includes, for example, a heating rotary member 46 and a pressing rotary member 47 in the interior of a housing for this device. The heating rotary member 46, which is, for example, a roller or a belt, is rotationally driven in a required direction; and is heated by a heating unit to maintain its surface temperature at a required temperature. The pressing rotary member 47, which is, for example, a roller or a belt, is driven and rotated by contacting the heating rotary member 46 at a required pressure substantially along a direction of a rotation axis of the heating rotary member 46.

In the fixing device 45, when images are to be formed, the piece of recording paper 9 to which the toner images have been second-transferred by the intermediate transfer device 30 is sent into and passes through a press-contact portion between the heating rotary member 46 and the pressing rotary member 47, so that the toner images are heated and pressed when passing through the press-contact portion. This causes the toner images to be fused and fixed to the piece of recording paper 9. The piece of recording paper 9 to which the toner images have been fixed moves forward along the transport path (indicated by the dot-and-dash line), is transported to the outside of the housing 10 by a pair of discharge rollers 48 disposed at the transport path, and is finally discharged onto and accommodated by the discharge accommodating unit 12.

In the image forming apparatus 1, by selecting and operating all of the image forming devices 2Y, 2M, 2C, and 2K or some of the image forming devices 2Y, 2M, 2C, and 2K (for at least two different toner colors), it is possible to form a color image formed with a combination of toners of all four colors (Y, M, C, and K) or toners of some of the colors. In addition, by operating one of the image forming devices 2Y, 2M, 2C, and 2K, it is possible to form, for example, a monochrome image formed with toner of one color, such as black.

Further, in the image forming apparatus 1, developer to be recovered that has been scraped off and removed by the belt cleaning device 36 of the intermediate transfer device 30 and the drum cleaning devices 26 of the four corresponding image forming devices 2Y, 2M, 2C, and 2K may be finally collected and recovered by one removable developer recovery container 6.

Structure of Removable Units

Next, the removable units 20Y, 20M, 20C, and 20K of the respective image forming devices 2Y, 2M, 2C, and 2K are described.

Figure 5:
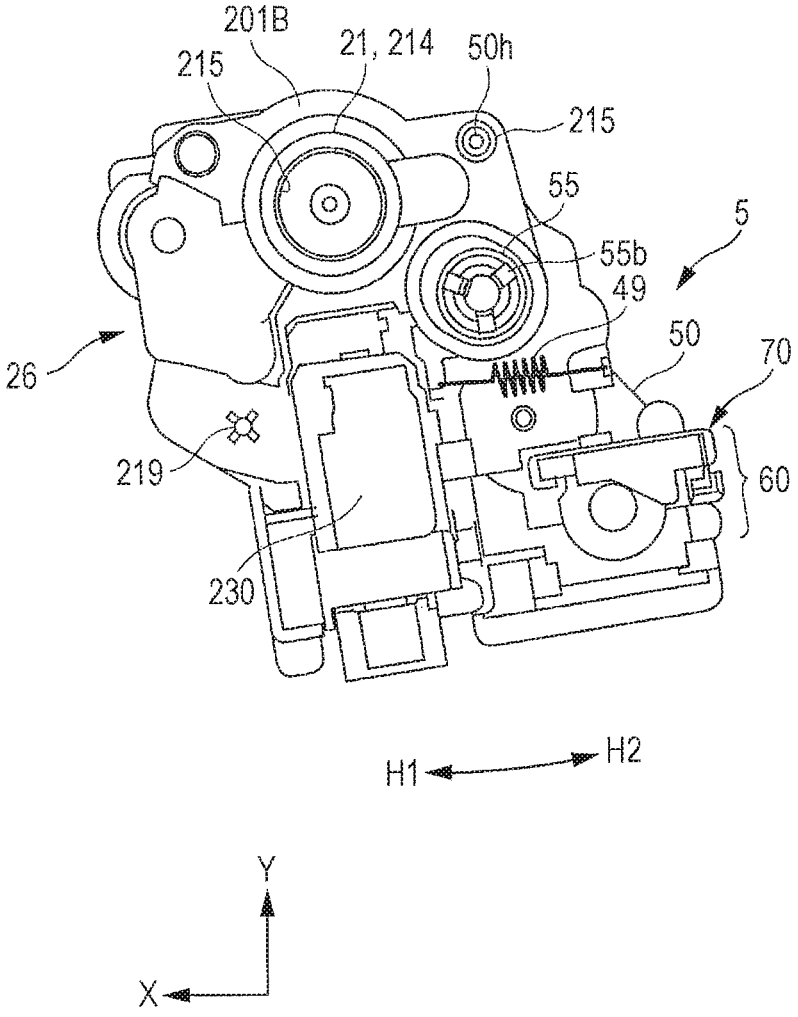
FIG. 5 is a back view illustrating a state of the removable unit (developing device) shown in FIG. 4 when seen from the end portion corresponding to the far side when each removable unit is mounted.
Figure 6:
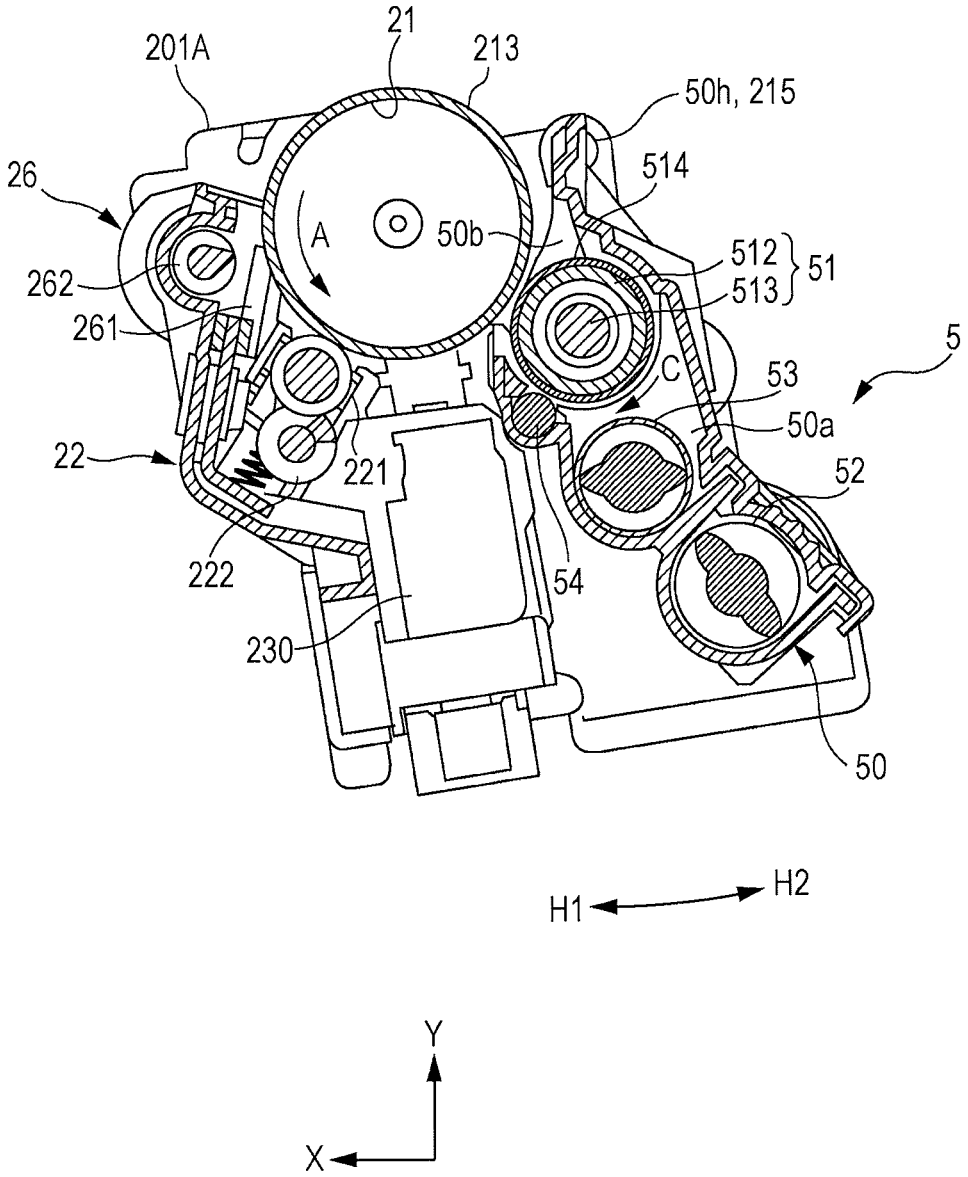
FIG. 6 is a sectional schematic view along line VI-VI of the removable unit (developing device) shown in FIG. 4.

Referring to, for example, from FIGS. 4 to 6, each of the removable units 20Y, 20M, 20C, and 20K is one in which its photoconductor drum 21, its charging device 22, the corresponding one of the developing devices 5Y, 5M, 5C, and 5K, and its drum cleaning device 26 are supported by the supporting frame 201 and are integrated with each other.

Of these, each supporting frame 201 principally includes two side plates, that is, a side plate 201A and a side plate 201B. If necessary, each supporting frame 201 may include, for example, connecting members (not shown) that connect the side plates. Reference numeral 219 in FIG. 4 denotes a positioning protrusion. Reference numeral 230 in each of FIGS. 5 and 6 denotes an accommodation space 230 that is formed between the charging device 22 and the corresponding developing device 5 for accommodating the corresponding exposure device 23. As mentioned above, each exposure device 23 is previously disposed at a side of the housing 10, and is accommodated in the accommodation space 230 when the removable unit 20 has been mounted on the corresponding mounting portion 13.

Each photoconductor drum 21 is, for example, one in which a photosensitive layer, formed of an organic conductive material or the like, is formed on an outer peripheral surface of a cylindrical conductive base that is connected to ground. Disk-shaped flanges 212 and 213 that form part of the conductive base are provided on respective ends of each photoconductor drum 21 in a longitudinal direction thereof. Each photoconductor drum 21 is rotatably mounted on the side plates 201A and 201B through shafts 214 protruding from the respective end portions of the corresponding photoconductor drum 21. Further, for example, a female connecting gear 215 is disposed inside the shaft 214 that is provided at an end portion corresponding to a far side (leading end side in an insertion direction) when the corresponding removable unit 20 is mounted.

Each charging device 22 is a contact-type charging device in which a charging roller 221 that is driven and rotated by contacting the image formation surface of the corresponding photoconductor drum 21 contacts the image formation surface of the corresponding photoconductor drum 21. Two end portions of each charging roller 221 are rotatably mounted on the side plates 201A and 201B. Each charging roller 221 is driven and rotated by contacting the outer peripheral surface of the corresponding photoconductor drum 21. Each charging roller 221 is provided with a cleaning brush roller 222 that cleans an outer peripheral surface of the corresponding charging roller 221 as a result of being rotated by contacting the outer peripheral surface of the corresponding charging roller 221.

Each drum cleaning device 26 includes, for example, a cleaning member 261 and a rotating transport member 262 in the interior of a housing for this device. Each cleaning member 261, which is, for example, an elastic plate, scrapes off undesired substances, such as residual toner, by contacting the outer peripheral surface of the corresponding photoconductor drum 21. Each rotating transport member 262, which is, for example, a screw auger, sends out the residual toner scraped off by the corresponding cleaning member 261 as waste toner towards the developer recovery container 6. Each drum cleaning device 26 is mounted with two end portions thereof being secured to the respective side plates 201A and 201B (or the respective connecting members).

As exemplified in FIG. 3, the removable units 20Y, 20M, 20C, and 20K are capable of being mounted on and dismounted from corresponding portions of (or spaces in) the mounting portions (which are provided as portions of the housing 10 of the image forming apparatus 1) by an inserting/removing operation (inserting operation and removing operation) in a direction of arrow D1 and in a direction of arrow D2. Each mounting portion 13 is formed as a space portion having depth as a result of further opening a portion of a mounting portion 10*f* of the developer recovery container 6 provided at a side surface portion 10*b* of the housing 10.

At each mounting portion 13 of the image forming apparatus 1, the following structural components are disposed at the leading end side of each removal unit 20 (that is, the far side of each mounting portion 13) in the insertion direction indicated by the arrow D1.

Figure 7:
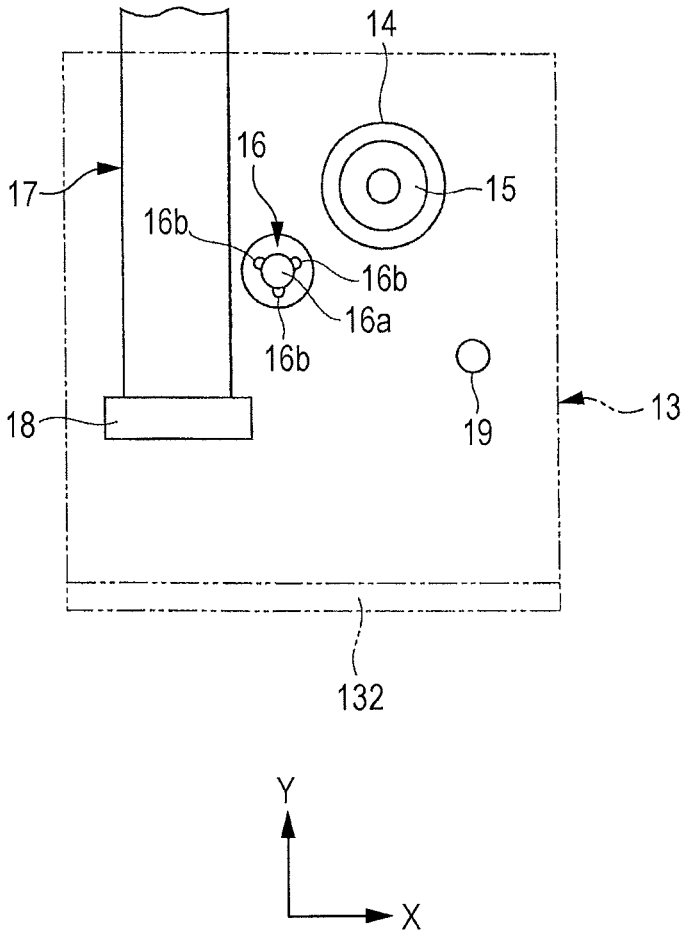
FIG. 7 is an enlarged general view of a structure of a portion corresponding to the far side of the mounting portion of the image forming apparatus shown in FIG. 1.

That is, as exemplified in FIG. 7, for example, a mounting hole 14, a male connecting driving gear 15, a driving-side shaft coupling 16, a supply transport pipe 17, and a positioning receiving hole 19 are disposed at the far side of each mounting portion 13. The shaft 214 of the photoconductor drum 21 of each removable unit 20 is fitted in the mounting hole 14. The female connecting gear 215 of each photoconductor drum 21 engages with and is connected to the connecting driving gear 15, so that the connecting driving gear 15 transmits rotary power to the corresponding photoconductor drum 21. A shaft coupling of each developing roller 51 (described later) is connected to the corresponding driving-side shaft coupling 16, so that the shaft coupling 16 transmits rotary power to the corresponding developing roller 51. Each supply transport pipe 17 transports supply developer (including the case in which only toner is used) to the corresponding developing device 5. The positioning protrusion 219 (see FIG. 4) of each removable unit 20 is fitted into the corresponding positioning receiving hole 19.

In FIG. 7, for conveniences' sake, one of the mounting portions 13 for mounting a corresponding one of the removable units 20 is shown as an exemplification. Reference number 132 in FIG. 7 denotes a holding table for holding, for example, one removable unit 20 at the mounting portion 13 from below the one removable unit 20 when inserting or removing the one removable unit 20.

Of these, the connecting driving gears 15 and the driving-side shaft couplings 16 are connected to a rotational driving device (not shown) that is disposed in the housing 10. Rotary power in a required direction is transmitted from the rotational driving device to the connecting driving gears 15 and the driving-side shaft couplings 16. As each driving-side shaft coupling 16, for example, a driving-side coupling in which multiple (for example, three) radially protruding connecting lugs 16*b* are provided on a front end portion of a bar-shaped rotary shaft 16*a* is used (see FIG. 7).

Each supply transport pipe 17 is connected to a send-out supplying device that takes out and sends out supply developer from a container that contains the supply developer (not shown). Each supply transport pipe 17 is such that a required amount of supply developer that is sent out from the supplying device is transported towards the corresponding developing device 5. Connecting components 18 (such as an opening/closing shutter at a discharge opening, a connection coupling structural unit) for connection with a supply receiving portion 60 (described later) of each of the corresponding developing devices 5 are mounted on an end portion of the corresponding supply transport pipe 17.

Structure of Developing Devices

Next, the developing devices 5Y, 5M, 5C, and 5K that form part of the respective removable units 20 are described.

For example, a two-component developing device that performs a developing operation by using two-component developer containing toner and carriers is used for each of the developing devices 5Y, 5M, 5C, and 5K. Referring to, for example, from FIGS. 4 to 6, each of the developing devices 5Y, 5M, 5C, and 5K is provided with a housing 50 having a shape with a length that allows it to face the entire region of the corresponding photoconductor drum 21 in an axial direction thereof.

Referring to, for example, FIG. 6, the housing 50 of each developing device 5 is a structure including an accommodating portion 50*a*, a rectangular development opening portion 50*b*, and the supply receiving portion 60. Each accommodating portion 50*a* includes a partition space for accommodating developer and circulating and transporting the developer. Each opening portion 50*b* is formed continuously with the corresponding accommodating portion 50*a* and faces the outer peripheral surface of the corresponding photoconductor drum 21 in the axial direction thereof. Each supply receiving portion 60 has a receiving opening 61 that receives supply developer that is supplied to the corresponding accommodating portion 50*a*.

Each housing 50 also includes the developing roller 51, screw augers 52 and 53, and a layer thickness restricting member 54 in the interior thereof. Each developing roller 51 is rotatably disposed while being positioned at a side of an accommodating portion 50*a* with respect to the corresponding opening portion 50*b* and with a portion thereof being exposed. The screw augers 52 and 53, which are exemplary stirring transport members, stir the developer accommodated in the corresponding accommodating portion 50*a* and transport the developer towards the corresponding developing roller 51. Each layer thickness restricting member has the shape of a round bar and restricts the thickness of a developer layer that is supplied to and held by the corresponding developing roller 51.

Of these, each developing roller 51 includes a cylindrical sleeve 512 that is disposed so as to rotate in the direction of arrow C and a magnet roller 513 that is disposed in the interior of the sleeve 512. Disk-shaped tracking rollers 514 that maintain a gap between the corresponding developing roller 51 and the image formation surface of the corresponding photoconductor drum 21 by contacting the flanges 212 and 213 at the respective end portions of the corresponding photoconductor drum 21 are provided on respective end portions of the corresponding developing roller 51.

Referring to, for example, FIGS. 4 and 5, a drive-side coupling 55, which serves as a shaft coupling, for receiving rotary power is mounted on an end portion of each developing roller 51, the end portion corresponding to the leading end side in the insertion direction D1 of each removable unit 20 into the corresponding mounting portion 13. Each drive-side coupling 55 includes, for example, a recessed portion and multiple (for example, three) lug receiving grooves 55*b* at a connection-side end portion of a cylindrical body 55*a*. A connection-side end portion of each driving-side coupling 16 is fitted to the corresponding recessed portion. The lug receiving grooves 55*b* are provided at an inside wall surface of the corresponding recessed portion and receive and hold the connecting lugs 16*b* of the corresponding driving-side coupling 16.

Figure 8:
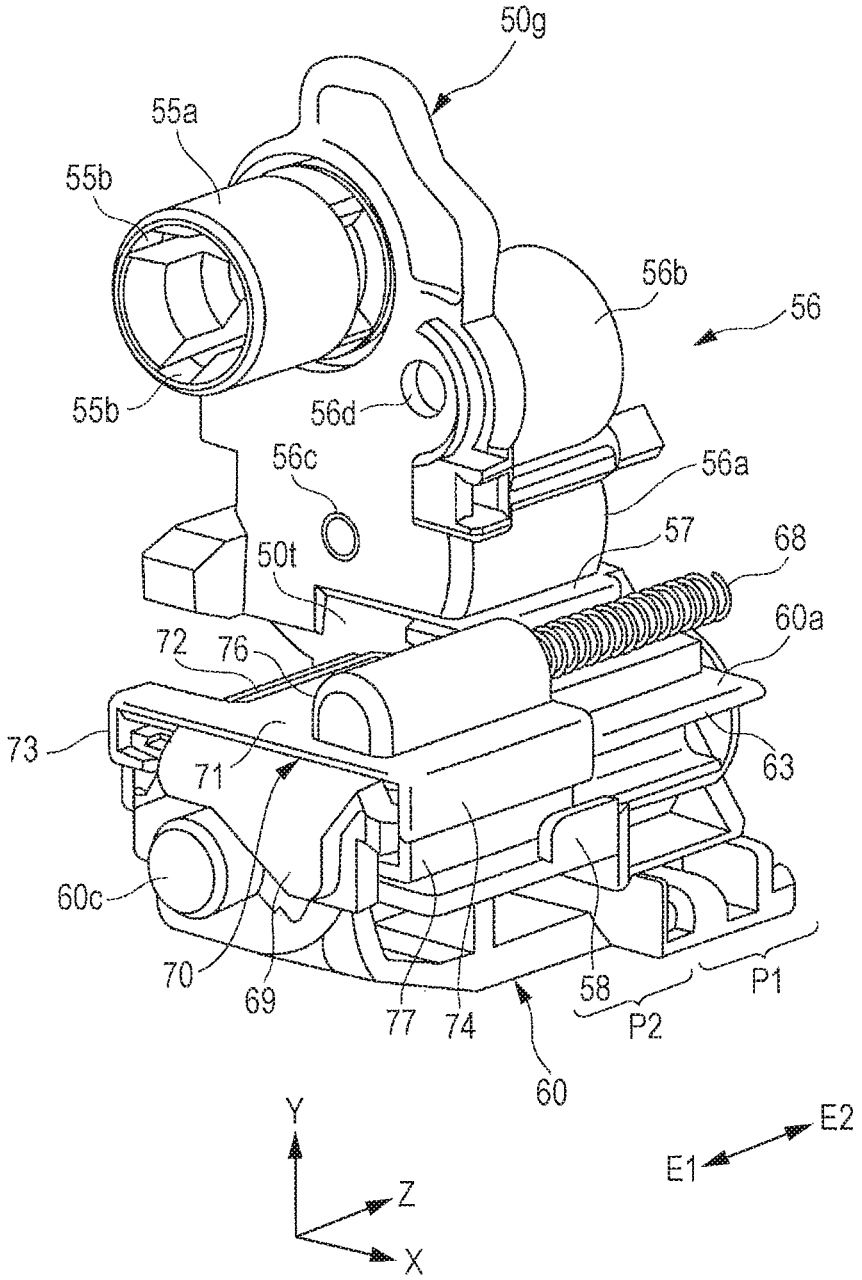
FIG. 8 is a perspective view of a structure of a supply receiving portion of the developing device shown in FIG. 4 and a structure of the vicinity thereof.
Figure 9:
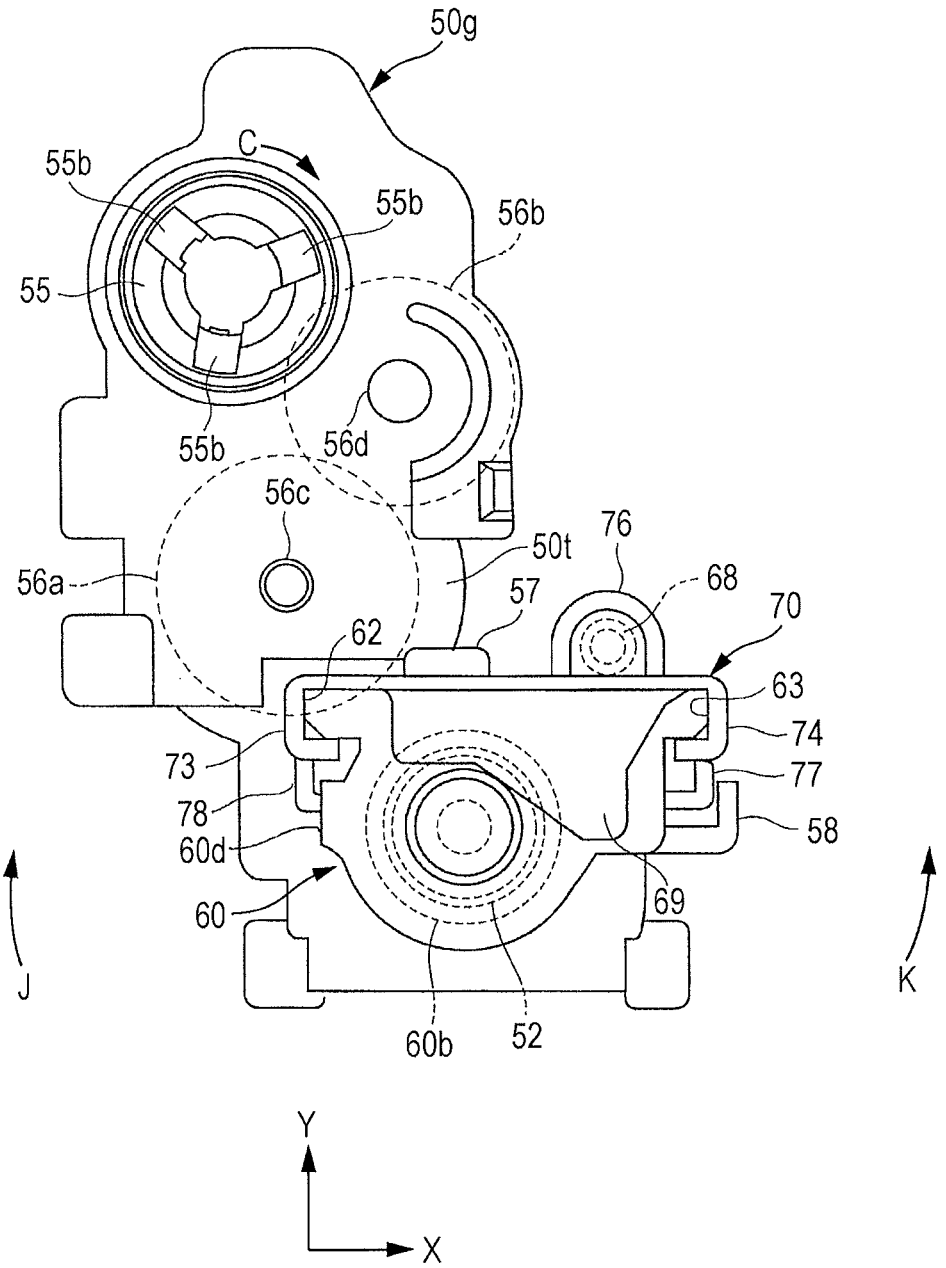
FIG. 9 is a schematic back view illustrating a state of the supply receiving portion of the developing device shown in FIG. 8 and the vicinity thereof when seen from the end portion corresponding to the far side when the removable unit is mounted.

Referring to FIGS. 8 and 9, the screw augers 52 and 53 are rotatably mounted in the accommodating portion 50*a* of the corresponding housing 50. Rotary power of each developing roller 51 is transmitted to the screw augers 52 and 53 via a gear train 56 serving as an exemplary rotation transmitting mechanism.

Each gear train 56 includes, for example, a transmission receiving gear 56*a* that is mounted on an end portion at one side of a rotary shaft of the screw auger 53 disposed close to the corresponding developing roller 51, a transmission gear (not shown) that is mounted on a shaft of the corresponding developing roller 51, and a relay gear (idler) 56*b* provided between the transmission gear and the transmission receiving gear 56*a*. Incidentally, rotary power is transmitted to each screw auger 52, which is disposed far away from the corresponding developing roller 51, from the transmission receiving gear 56*a* at the corresponding screw auger 53 through a gear. The term "one side" refers to the leading end side in the insertion direction D1 of each removable unit 20 into the corresponding mounting portion 13.

Figure 10:
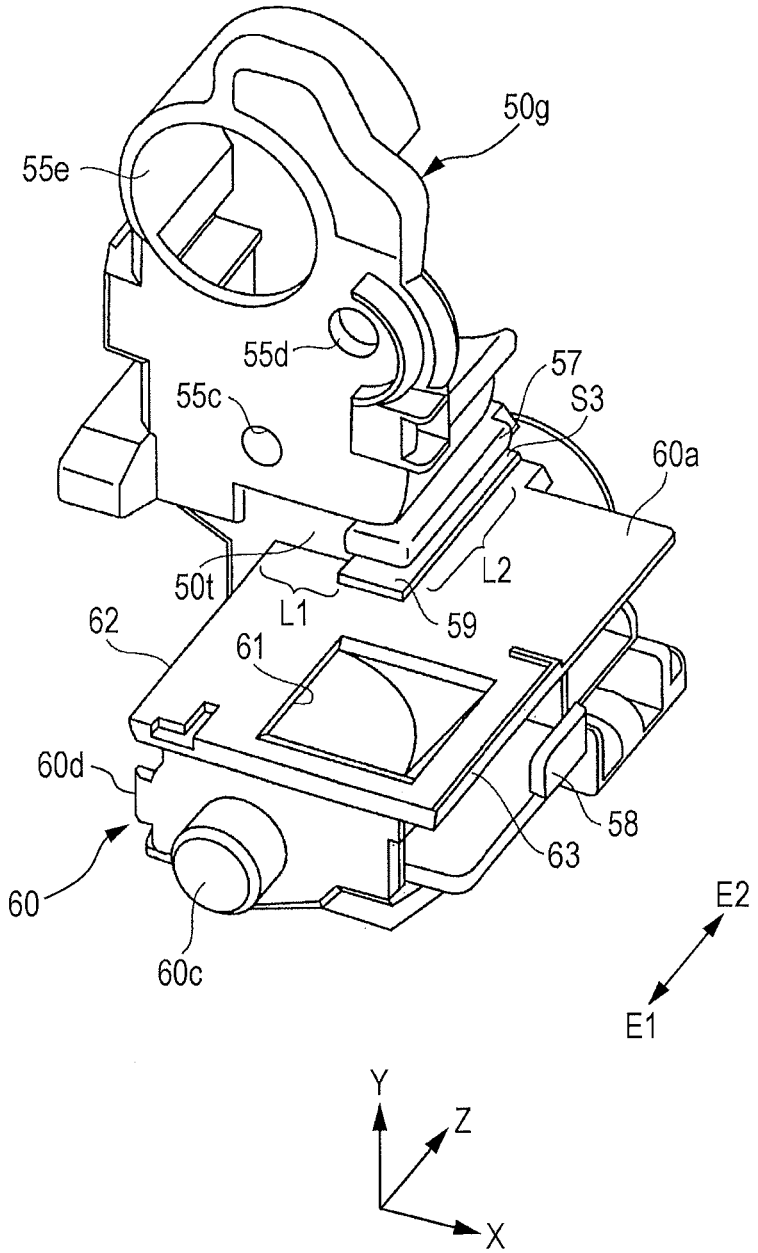
FIG. 10 is a schematic perspective view of the supply receiving portion of the developing device shown in FIG. 4 and the structure of the vicinity thereof (where some components, such as an opening/closing shutter, are not shown)

Symbol 50*g* in, for example, each of FIGS. 8, 9, and 10 denotes a gear cover that supports and protects the corresponding gear train 56, and forms part of the corresponding housing 50. Symbol 56*c* denotes a bearing hole for the rotary shaft of the corresponding screw auger 53. Symbol 56*d* denotes a bearing hole for the corresponding relay gear 56*b*. Symbol 55*e* denotes a through hole for arrangement of a corresponding driving gear (not shown) and the corresponding driving-side coupling 16 mounted on one end portion of the shaft of the corresponding developing roller 51. In FIGS. 8 and 9, the teeth of the gears 56*a* and 56*b* are not shown.

Referring from FIGS. 4 to 6, each developing device 5 is mounted on the corresponding removable unit 20 by fitting rotating supporting portions 50*h*, which are formed at portions extending from two end portions of the development opening portion 50*b* of the corresponding housing 50, into rotation bearing holes 215, which are formed in the side plates 201A and 201B of the corresponding removal unit 20. By such a mounting structure, each developing device 5 is supported so as to be rotatably in the directions of arrows H1 and H2 around the rotating supporting portions 50*h* of the corresponding removable unit 20.

Each developing device 5 is pushed in the direction of arrow H1 by a corresponding coil spring 9 that is mounted between a portion of the corresponding housing 50 and each of the side frames 201A and 201B. By this, each developing device 5 is given assistance in contacting the tracking rollers 514 of the corresponding developing roller 51 with the flanges 212 and 213 of the corresponding photoconductor drum 21.

Referring to, for example, FIGS. 4, 6, and 8, the supply receiving portion 60 of each housing 50 is formed as a portion in which a portion of the accommodating portion 50*a* of the corresponding housing 50 near an end portion situated at one side of the screw auger 52 disposed far away from the corresponding developing roller 51 extends and protrudes outward along an axial direction from the corresponding accommodating portion 50*a* along with the end portion at one side of the screw auger 52 in continuation with a portion of the space of the corresponding accommodating portion 50*a*. Referring to, for example, from FIGS. 8 to 10, each supply receiving portion 60 has a planar top surface portion 60*a*. Each rectangular receiving opening 61 that receives supply developer is provided in a portion of the corresponding planar top surface portion 60*a*.

The outer side of each accommodating portion 50*a* corresponds to a side in which the corresponding supply receiving portion 60 protrudes from a side surface portion of the corresponding accommodating portion 50*a*. In the exemplary embodiment, the outer side of each accommodating portion 50*a* corresponds to a downstream side in the insertion direction D1 of each removable unit 20. Symbol 60*b* in FIG. 9 denotes a cylindrical supply transport path that is connected to the corresponding accommodating portion 50*a* in the interior of the corresponding supply receiving portion 60. Each extended screw auger 52 exists at the corresponding supply transport path 60*b*. Symbol 60*c* in FIG. 10 refers to a bearing accommodating unit that accommodates a bearing that supports an end portion of the shaft of the corresponding screw auger 52.

Referring to, for example, FIGS. 4, 5, and 8, an opening/closing shutter 70 is mounted on the supply receiving portion 60 of the housing 50 of each of the developing devices 5Y, 5M, 5C, and 5K. Each opening/closing shutter 70 moves linearly along the directions of arrows E1 and E2 between a position (P1) where the receiving opening 61 is uncovered and a position (P2) where the receiving opening 61 is covered. The opening/closing shutters 70 are described in detail later.

Further, the supply receiving portion 60 of each of the developing devices 5Y, 5M, 5C, and 5K includes guiding portions 62 and 63 that guide the corresponding opening/closing shutter 70 such that it moves linearly, and a coil spring 68 that pushes the corresponding opening/closing shutter 70 towards the position where the receiving opening 61 is covered.

The guiding portions 62 and 63 are formed by forming left and right end portions in movement directions E1 and E2 of the corresponding opening/closing shutter 70 along the planar top surface portion 60*a* of the corresponding supply receiving portion 60 into plate shapes that extend linearly along the movement directions E1 and E2. One end of each coil spring 68 is mounted in a fixed state on a portion of its corresponding housing 50, and the other end thereof is disposed so as to contact a portion (76) of the corresponding opening/closing shutter 70. By this, each coil spring 68 pushes the corresponding opening/closing shutter 70 by a required spring force F in the direction of arrow E1. Reference numeral 69 in FIGS. 8 and 9 denotes a member that prevents leakage of developer at the corresponding supply receiving portion 60. Each member 69 is affixed to the top surface portion 60*a* of the corresponding supply receiving portion 60, and comes into contact with the corresponding opening/closing shutter 70 to close any gaps, as a result of which the leakage of developer is prevented.

Figure 11:
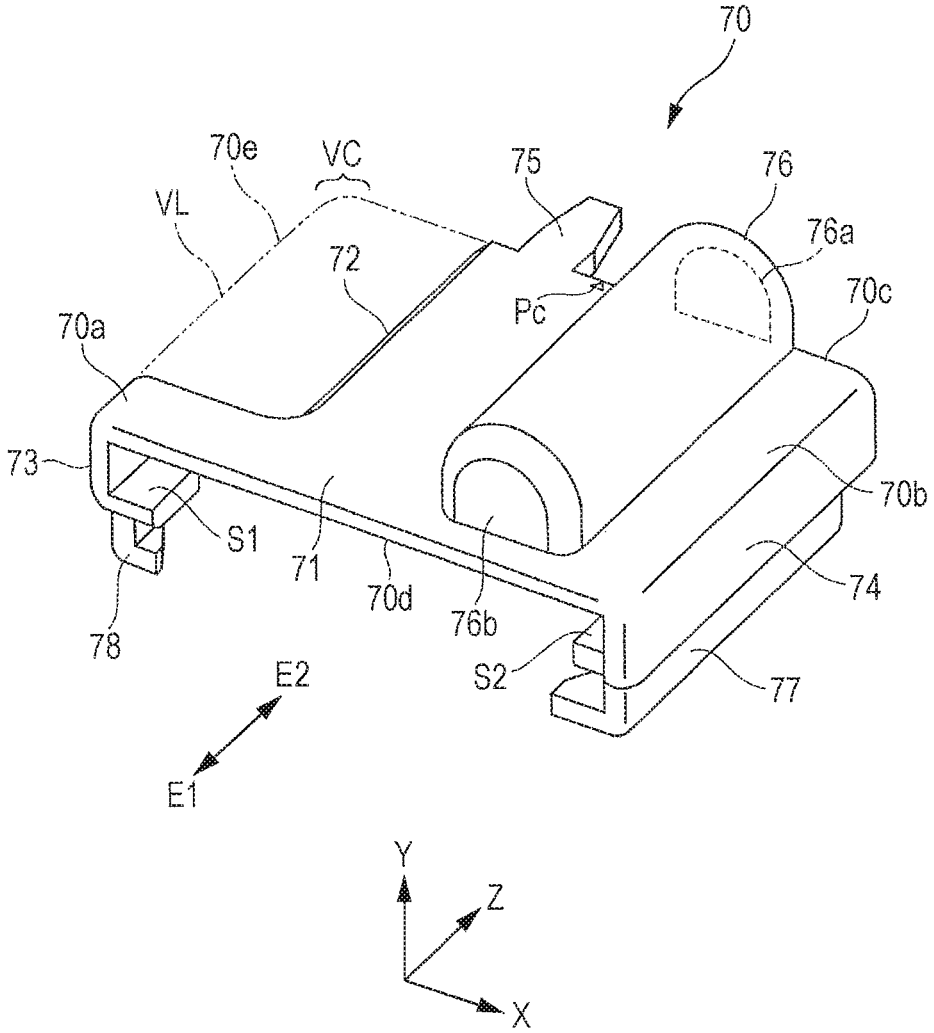
FIG. 11 is an enlarged perspective view of the opening/closing shutter that is mounted on the supply receiving portion of the developing device shown in FIG. 4.

Referring to, for example, FIGS. 8, 9, and 11, each opening/closing shutter 70 includes a body 71, guide portions 73 and 74, and an extended protrusion 75. Each body 71 has a cutaway end portion 72 that is formed by cutting away a corner 70*e* located at one of left and right end portions 70*a* and 70*b*, that is, the left end portion 70*a*, the left and right end portions 70*a* and 70*b* corresponding to the left and right sides when the opening/closing shutter 70 moves in the directions of arrows E1 and E2 along the corresponding supply receiving portion 60. The guide portions 73 and 74 are provided at the end portions 70*a* and 70*b* except where the cutaway end portion 72 of the corresponding body 71 exists and are guided by contacting the guiding portions 62 and 63 of the corresponding supply receiving portion 60 so as to surround the guiding portions 62 and 63 from the outer sides thereof. Each extended protrusion 75 is formed by causing at least a portion of an end portion 70*c* of the corresponding body 71 to extend and protrude in the opening direction E2 when the opening/closing shutter 70 moves to the position where the receiving opening 61 is uncovered, the end portion 70*c* corresponding to a leading side in the opening direction E2.

Of these, each body 71 is a plate member having a wideness that at least allows the corresponding receiving opening 61 to be covered.

It is desirable that each body 71 be actually formed as a member whose planar shape is a square shape. The term "square shape" refers to a planar shape where the body 71 includes an imaginary portion indicated by an alternate long and two short dashed line VL in FIG. 11.

However, in each developing device 5, referring to, for example, from FIG. 8 to FIG. 10, a portion 50*t* of the gear cover 50*g* of each housing 50 (that is, a portion where the transmission receiving gear 56*a* at the corresponding screw auger 52 exists) is a protruding portion that protrudes towards the planar top surface portion 60*a* of the corresponding supply receiving portion 60. Each protruding portion 50*t* becomes an obstacle when the corresponding opening/closing shutter 70 moves to the position (P1) where the corresponding receiving opening 61 is uncovered.

Therefore, the face shape of the top surface portion 60*a* of the supply receiving portion 60 of each developing device 5 is not a simple square shape but is a shape formed as if by eroding and narrowing a portion of a region of the top surface portion 60*a* by an amount corresponding to the protruding portion 50*t* of the corresponding housing (see FIG. 10). In addition, in each opening/closing shutter 70 that is mounted on the corresponding supply receiving portion 60 where the protruding portion 50*t* exists, the planar shape of the body 71 is one formed by the cutaway end portion 72, which is formed by cutting away an end portion of the body 71, for preventing a collision with the protruding portion 50*t* of the corresponding housing when the opening/closing shutter 70 exits at the position (P1) where the receiving opening 61 is uncovered.

Incidentally, in order to prevent the protruding portion 50*t* of each of the aforementioned gear covers 50*g* from becoming an obstacle to the opening/closing operation of the corresponding opening/closing shutter 70, the supply receiving portion 60 having the receiving opening 61 may be provided so as to exist at a location that is away from the corresponding protruding portion 50*t* (that is, at a location that is displaced in a direction indicated by a coordinate axis X in FIG. 9), to mount the corresponding opening/closing shutter 70 whose planar shape is a rectangular shape on the corresponding supply receiving portion 60. However, when such a structure is used, the size of each housing 50 is increased. Therefore, this structure becomes an obstacle when reducing the size of each developing device 5.

Referring to, for example, FIG. 10, each of the above-described protruding portion 50*t* is in a state in which it extends over the corresponding opening/closing shutter 70 by a predetermined length L1 from an end portion at one side (for example, the left side in FIG. 10 or the like) of the corresponding opening/closing shutter 70 in the movement directions E1 and E2 to an inner side thereof; and in which it extends over the corresponding opening/closing shutter 70 by a predetermined length L2 from the end portion 70*c* in the closing direction E1 to the position (P2) where the receiving opening 61 is covered, the end portion 70*c* corresponding to a leading side in the opening direction E2 of the corresponding opening/closing shutter 70.

Referring to, for example, FIG. 11, each cutaway end portion 72 in the first exemplary embodiment is formed by cutting away a portion of the left end portion 70*a* (of the left end portion 70*a* and the right end portion 70*b* in the movement directions of the corresponding opening/closing shutter 70) of the corresponding body 71 by a substantially planar square (whose vertical and horizontal dimensions in a plane are slightly larger than L2×L1) including an imaginary corner VC corresponding to the leading side in the opening direction E2. In addition, each cutaway end portion 72 is formed so as to exist at a location that is closer to the left end portion 70*a* than a center position Pc (FIG. 11) between both the end portions 70*a* and 70*b* of the corresponding body 71.

The guide portion 73 of each opening/closing shutter 70 is formed as a portion which extends downward from the entire region of the end portion 70*a* (at a side where the cutaway end portion 72 exists) of the corresponding body 71, which then extends substantially parallel to the top surface of the corresponding body 71, and which is slightly bent inward. Each guide portion 73 has a guiding space S1 at a portion that is surrounded by the bottom surface of the corresponding body 71. The guiding portion 62 at one side of each supply receiving portion 60 is fitted into the corresponding guiding space S1 so as to be covered and sandwiched therein from the outer side thereof.

The other guide portion 74 of each opening/closing shutter 70 is formed as a portion which extends downward from the entire region of the end portion 70*b* (at a side where the cutaway end portion 72 does not exist) of the corresponding body 71, which then extends substantially parallel to the top surface of the corresponding body 71, and which is slightly bent inward. Each guide portion 74 has a guiding space S2 at a portion that is surrounded by the bottom surface of the corresponding body 71. The guiding portion 63 at the other side of each supply receiving portion 60 is fitted into the corresponding guiding space S2 so as to be covered and sandwiched therein from the outer side thereof.

The extended protrusion 75 of each opening/closing shutter 70 is formed as a wedge-shaped portion formed by extending the end portion 70*c*, which corresponds to a leading side in the opening direction E2, of the body 71 by a required width and length in the opening direction E2.

The protruding length of each extended protrusion 75 from the corresponding end portion 70*c* is set to a value that allows a tip portion 75*a* of the corresponding cylindrical protrusion to reach and to be sandwiched by a sandwiching holding portion (57) (described later) when the corresponding opening/closing shutter 70 is at the closing position P2. Each extended protrusion 75 is formed at a portion of the end portion 70*c* of the corresponding body 71 situated closer to the side where the cutaway end portion 72 exists than the center position Pc between both the end portions 70*a* and 70*b*.

Referring to, for example, FIG. 11, each opening/closing shutter 70 includes an accommodating holding unit 76 that is disposed on the top surface portion thereof and that accommodates and holds the other end portion of the coil spring 68.

Each accommodating holding unit 76 has a tunnel-like internal space portion where only one end at a side of the end portion 70*c* of the body 71 is open (this open end corresponds to an opening portion 76*a*). The other end portion of each coil spring 68 is accommodated and held in the corresponding internal space portion. Each accommodating holding portion 76 has a closed end portion 76*b* which, when connecting the supply receiving portion 60 to the corresponding supply transport pipe 17, contacts the connecting components 18 at the supply transport pipe 17 and is subjected to external force that pushes the corresponding opening/closing shutter 70 in the direction E2.

Reference numeral 77 in, for example, FIG. 11 denotes a restriction portion that is under restriction as a result of contacting a restricting portion (58) (described later) to suppress unnecessary movement of the corresponding opening/closing shutter 70. Reference numeral 78 denotes a portion that contacts a portion (such as a portion 60*d*) of the corresponding supply receiving portion 60 and restricts the position of the corresponding opening/closing shutter 70 (such as a stoppage position when the opening/closing shutter 70 is moved in the movement direction E1). In, for example, FIGS. 10, 12, and 13, the developer leakage preventing member 69 described above is not illustrated.

Referring to, for example, from FIG. 8 to FIG. 10, each developing device 5 includes the sandwiching holding portion 57 that is provided at the corresponding housing 50 and that holds at least a portion of the extended protrusion 75 of the corresponding opening/closing shutter 70 (such as the tip portion 75*a*) by sandwiching the portion of the extended protrusion 75 by the sandwiching holding portion 57 and the supply receiving portion 60.

Referring to FIG. 10, each sandwiching holding portion 57 is formed as a plate portion at a portion of the protruding portion 50*t* at the corresponding gear cover 50*g* (which is a portion of the housing 50) facing the top surface portion 60*a* of the corresponding supply receiving portion 60. Each sandwiching holding portion 57 is formed substantially parallel to the top surface portion 60*a* so as to be separated therefrom by a required distance. Each sandwiching holding portion 57 has a holding space S3 in which, by the top surface portion 60*a* of the supply receiving portion 60 and the sandwiching holding portion 57, a portion of the corresponding opening/closing shutter 70 (a portion of the extended protrusion 75 and the cutaway end portion 72) is accommodated and held so as to allow it to pass therethrough. Reference numeral 59 in FIG. 10 denotes a portion which, after the above-described developer leakage preventing member 69 has been affixed to the top surface portion 60*a* of the corresponding supply receiving portion 60, becomes a sliding surface when the corresponding opening/closing shutter 70 moves to restrict a movement position of the corresponding opening/closing shutter 70.

Further, referring to, for example, from FIG. 8 to FIG. 10, each developing device 5 includes the restricting portion 58 at the supply receiving portion 60 of the corresponding housing 50. Each restricting portion 58 contacts the end portion 70*b* (where the cutaway end portion 72 of the corresponding opening/closing shutter 70 does not exist) from the outer side thereof and restricts movement of the corresponding opening/closing shutter 70 in a direction K (see FIG. 12) that crosses the movement directions E of the corresponding opening/closing shutter 70.

Each restricting portion 58 is formed as a portion that contacts the restriction portion 77 of the corresponding opening/closing shutter 70 described above from the outer side thereof. The shape and the position of each restricting portion 58 are such as to allow each restricting portion 58 to contact the corresponding restriction portion 77 at least when the opening/closing shutter 70 exists at the closing position P2 and the opening/closing shutter 70 moves in the opening direction E2.

Mounting of Opening/Closing Shutters and Mounting State

The opening/closing shutter 70 of each developing device 5 is mounted on the supply receiving portion 60 of the corresponding housing 50 as follows.

Figure 12:
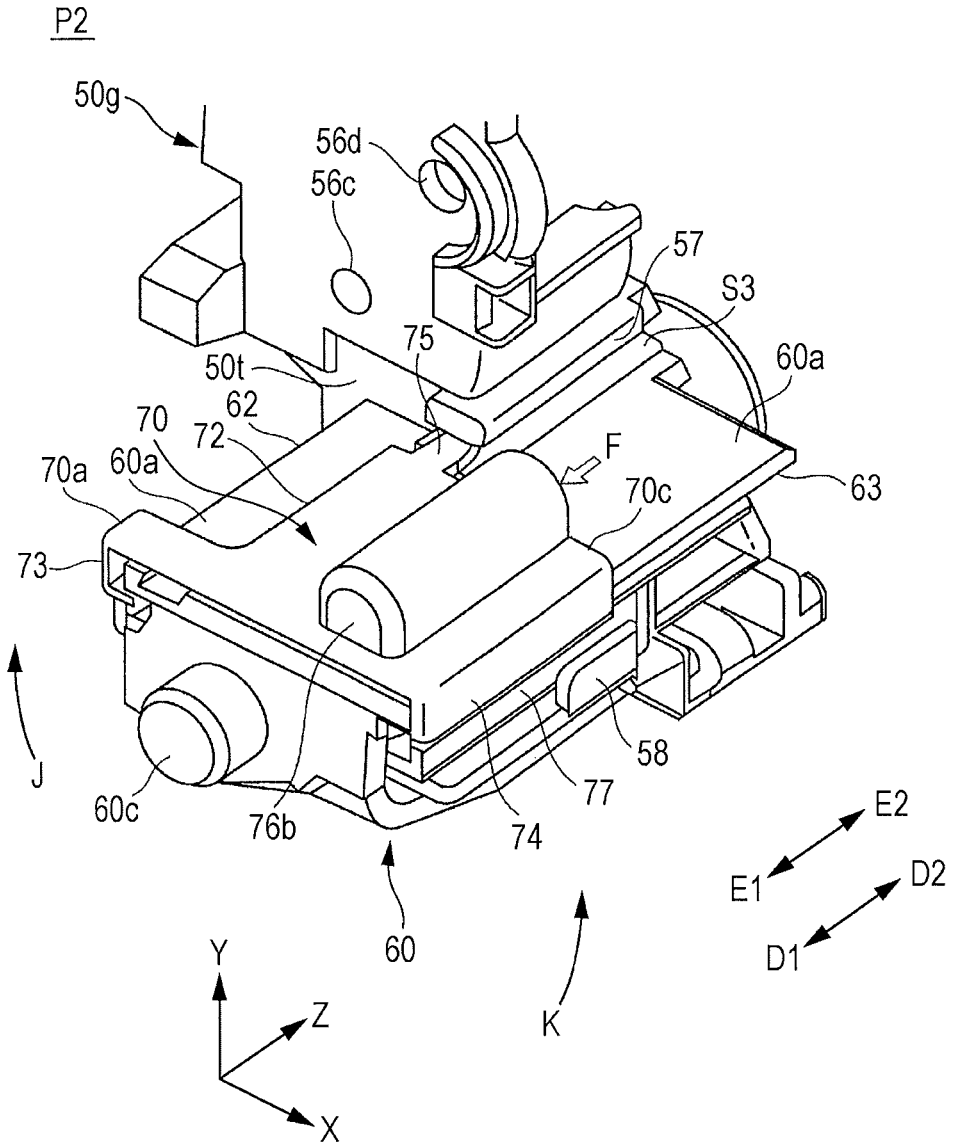
FIG. 12 is a schematic perspective view illustrating a state when the opening/closing shutter of the developing device shown in FIG. 4 is displaced to a position where a receiving opening is covered.

That is, first, referring to, for example, FIGS. 8, 9, and 12, with each end portion 70*c* in the opening direction E2 being the leading side, the body 71 of each opening/closing shutter 70 is brought closer to the top surface portion 60*a* of the corresponding supply receiving portion 60 (principally, the region where the receiving opening 61 exists), after which the guide portion 73 and the guide portion 74 on the left end portion 70*a* and the right end portion 70*b*, respectively, are mounted so as to be fitted to the guiding portion 62 and the guiding portion 63 of the supply receiving portion 60. Next, the other end portion of each coil spring 68 is accommodated in the internal space portion of the accommodating holding portion 76 of the corresponding opening/closing shutter 70.

By these operations, each opening/closing shutter 70 is mounted on the corresponding supply receiving portion 60.

Each opening/closing shutter 70 mounted on the corresponding supply receiving portion 60 is guided by the guiding portions 62 and 63, and is brought in a state in which it is capable of moving linearly in the directions of arrows E1 and E2. Each opening/closing shutter 70 is kept in a state in which it is elastically pushed by the spring force F of the corresponding coil spring 68 in the direction of arrow E1 (unless an external force in the opening direction E2 is applied) and displaced at the position P2 where the receiving opening 61 of the corresponding supply receiving portion 60 is covered.

Incidentally, when each opening/closing shutter 70 is displaced to the position P2 where the receiving opening 61 is covered, the movement of each opening/closing shutter 70 in the opening direction E2 is capable of being stopped when a portion at a side of an end portion 70*d* of the body contacts a portion of the corresponding supply receiving portion 60. When each opening/closing shutter 70 is displaced to the position P1 where the receiving opening 61 is uncovered, the movement of each opening/closing shutter 70 in the closing direction E1 is capable of being stopped when the end portion 70*c* of the corresponding body contacts an end portion where each connecting component 18 at the supply transport pipe 17 at the side of the apparatus body is formed.

Figure 14:
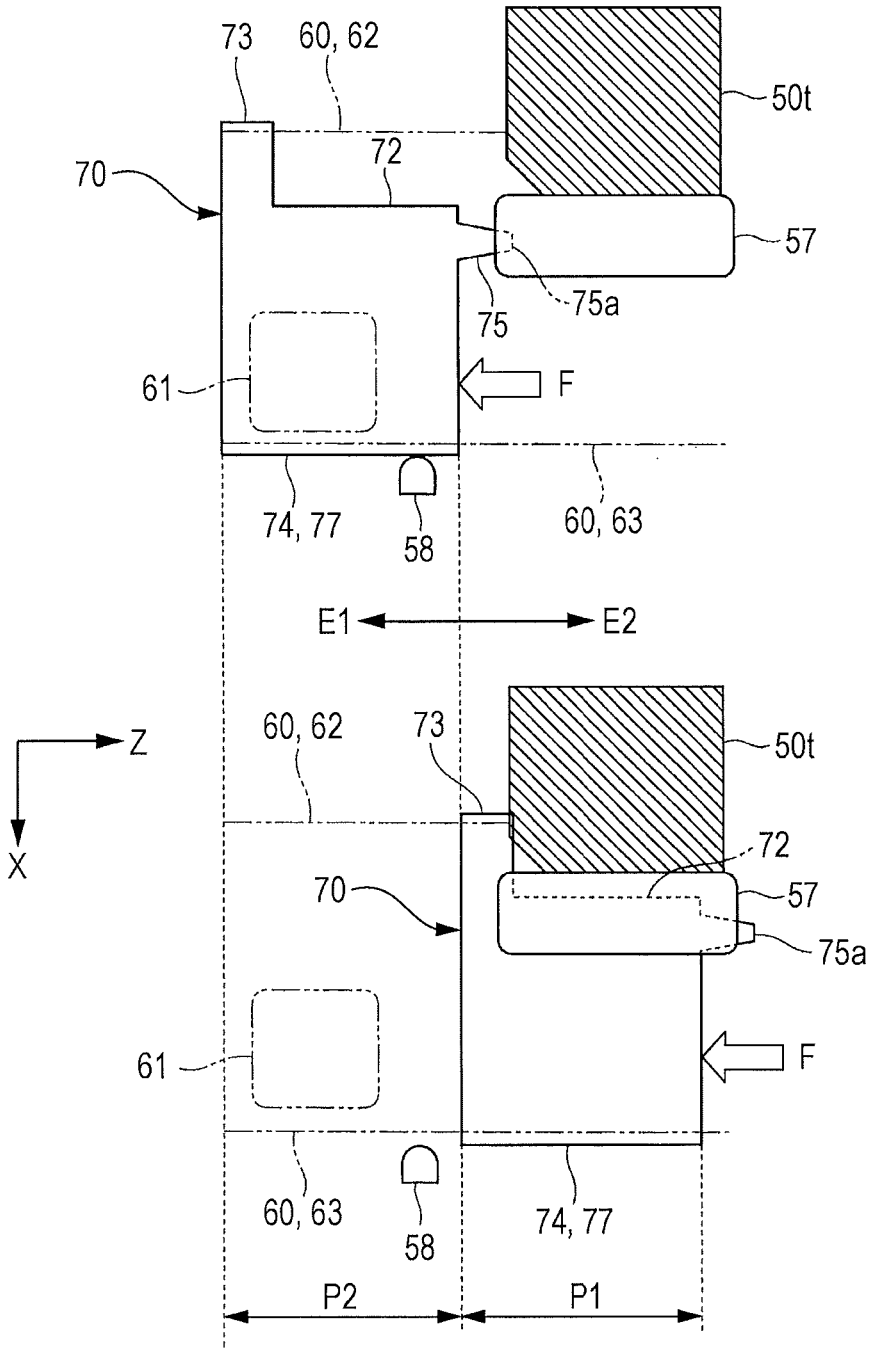
FIG. 14 is an explanatory view illustrating structures and states of, for example, the supply receiving portion (receiving opening and guiding portions), the opening/closing shutter, a sandwiching holding portion, and restricting portion of the developing device shown in FIG. 4, when the opening/closing shutter is at the position where the receiving opening is covered and when the opening/closing shutter is at the position where the receiving opening is uncovered.

When each removable unit 20 including the corresponding developing device 5 is not mounted on the corresponding mounting portion 13 of the image forming apparatus 1 (that is, when each supply receiving portion 60 is not connected to the supply transport pipe 17), referring to, for example, FIGS. 8, 12, and 14, each opening/closing shutter 70 is displaced to the position P2 where the receiving opening 61 of the corresponding supply receiving portion 60 is covered. Here, each opening/closing shutter 70 is mounted by surrounding the guiding portions 62 and 63 of the corresponding supply receiving portion 60 by the guide portion 73 and the guide portion 74 on the left end portion 70*a* and the right end portion 70*b*, respectively, from the outer sides of the guiding portions 62 and 63 of the corresponding supply receiving portion 60 and causing the guiding portions 62 and 63 to be caught by the guide portions 73 and 74 from the outer sides thereof.

However, since the body 71 of each opening/closing shutter 70 has the cutaway end portion 72, the length for fitting the guide portion 73 and the guiding portion 62 together is shorter than the length for fitting the guiding portion 74 and the guiding portion 63 together. Therefore, holding force of the left end portion 70*a* (at the side where the cutaway end portion 72 exists) with respect to the supply receiving portion 60 is relatively less than holding force of the right end portion 70*b* with respect to the supply receiving portion 60.

Each opening/closing shutter 70 is disposed such that its coil spring 68 (accommodating holding portion 76) is disposed closer to the right end portion 70*b* (at the side where the cutaway end portion 72 does not exist) than the center position Pc between the left and right end portions of the corresponding opening/closing shutter 70. Therefore, the spring force F of each coil spring 68 acts upon a location that is situated closer to the end portion 70*b* (at the side where the cutaway end portion 72 does not exist) than the center position Pc instead of upon the center position Pc of the corresponding opening/closing shutter 70.

As a result, referring to, for example, FIGS. 9 and 12, the corresponding cutaway end portion 72 tends to move in the direction of arrow J, as a result of which each opening/closing shutter 70 may be placed in an unstable state in which it is raised from the top surface portion 60*a* of the corresponding supply receiving portion 60.

Regarding this point, referring to the top portion in FIGS. 12 and 14, even if each opening/closing shutter 70 is at the position (P2) where the receiving opening 61 is covered, the tip portion 75*a* of the corresponding extended protrusion 75 (provided closer to the cutaway end portion 72 at the end portion 70*c* of the body 71) is sandwiched in the holding space S3 formed between the top surface portion 60*a* of the supply receiving portion 60 and the sandwiching holding portion 57 (provided at the gear cover 50*g* of the housing).

By this, the aforementioned movement of each opening/closing shutter 70 in the direction of arrow J is restricted, so that each opening/closing shutter 70 will not be placed in an unstable state in which it is raised from the top surface portion 60*a* of the corresponding supply receiving portion 60.

Mounting/Dismounting Operations of Developing Devices and Operations Accompanying Mounting/Dismounting Operations Mounting/dismounting operations of the removable units 20Y, 20M, 20C, and 20K each including the developing device 5, and operations accompanying such mounting/dismounting operations are hereunder described.

First, as shown in FIG. 3, each of the removable units 20Y, 20M, 20C, and 20K is principally mounted by inserting each removable unit 20 into a predetermined portion of the corresponding mounting portion 13 of the image forming apparatus 1 while moving each removable unit 20 in an insertion direction corresponding to the direction of arrow D1, with an end portion of each removable unit 20 corresponding to the far side when each removable unit 20 is mounted being a leading side.

During the mounting, at the far side when each removable unit 20 is mounted, the shaft 214 of the corresponding photoconductor drum 21 is fitted into the mounting hole 14 of the corresponding mounting portion 13 and the positioning protrusion 219 is fitted into the positioning receiving hole 19 in the corresponding mounting portion 13. By this, the far side of each removable unit 20 is positioned with respect to the far side of the corresponding mounting portion 13. The positioning of a near side of each removable unit 20 with respect to the corresponding mounting portion 13 is performed by operating structural components (not shown).

During the mounting, at the far side when each removable unit 20 is mounted, the connecting gear 215 of the corresponding photoconductor drum 21 engages and is connected with the connecting driving gear 15 of the corresponding mounting portion 13, and the drive-side coupling 55 of the developing roller 51 of the corresponding developing device 5 is joined to and connected with the driving-side coupling 16 of the corresponding mounting portion 13. By this, it is possible to transmit rotary power to the photoconductor drum 21 and the developing roller 51 (and thus the screw augers 52 and 53) of each removable unit 20.

Further, during the mounting, at the far side when each removable unit 20 is mounted, the supply receiving portion 60 of the corresponding developing device 5 is brought close to and is connected with (the connecting components 18 at) the supply transport pipe 17 of the corresponding mounting portion 13.

Each supply receiving portion 60 and each supply transport pipe 17 are connected with each other as follows.

That is, first, when the far side of each removable unit 20 reaches the far-side portion of the corresponding mounting portion 13, the supply receiving portion 60 of each developing device 5 is placed in a state in which, for example, the closed end portion 76*b* of the accommodating holding portion 76 of the corresponding opening/closing shutter 70 contacts predetermined portions of the connecting components 18 at the supply transport pipe 17; and each removable unit 20 is inserted and moved into the far-side portion of the corresponding mounting portion 13, so that the connecting components 18 at the corresponding supply transport pipe 17 secured and disposed at the side of the corresponding mounting portion 13 are placed in a state in which they push the corresponding opening/closing shutter 70 in the opening direction E2. By this, each opening/closing shutter 70 is guided so as to move in a straight line by the guiding portions 62 and 63 of the corresponding supply receiving portion 60 and moves in the direction of arrow E2 against the spring force F of the corresponding coil spring 68.

Even when each opening/closing shutter 70 moves in the opening direction E2, due to the same reason mentioned above, the corresponding cutaway end portion 72 tends to move in the direction of arrow J, as a result of which each opening/closing shutter 70 may be placed in an unstable state in which it is raised from the top surface portion 60*a* of the corresponding supply receiving portion 60.

However, in each opening/closing shutter 70, the corresponding extended protrusion 75 passes through the holding space S3 with the extended protrusion 75 being continuously kept in a state in which it is interposed in the holding space S3 formed between the sandwiching holding portion 57 and the top surface portion 60*a* of the corresponding supply receiving portion 60. Therefore, it is possible to restrict the aforementioned movement in the direction of arrow J and to stably move each opening/closing shutter 70 in the opening direction E2.

When, as mentioned above, the closed end portion 76*b* of each accommodating holding unit (which is disposed closer to a certain side) is pushed as a result of contacting the connecting components 18 at the corresponding supply transport pipe 17, referring to, for example, FIGS. 9 and 12, each end portion 70*b* (at the side where the cutaway end portion 72 does not exist) tends to move in the direction of arrow K, as a result of which each opening/closing shutter 70 may be placed in an unstable state in which it is raised from the top surface portion 60*a* of the corresponding supply receiving portion 60.

However, in each opening/closing shutter 70, its end portion 70*b* (restriction portion 77) at the side where the corresponding cutaway end portion 72 does not exist contacts the restricting portion 58 at the supply transport pipe 17 to restrict (suppress) the movement of the corresponding opening/closing shutter 70 in a direction crossing the movement directions E. Therefore, it is possible to restrict the aforementioned movement in the direction of arrow K and stably move each opening/closing shutter 70 in the opening direction E2.

Figure 13:
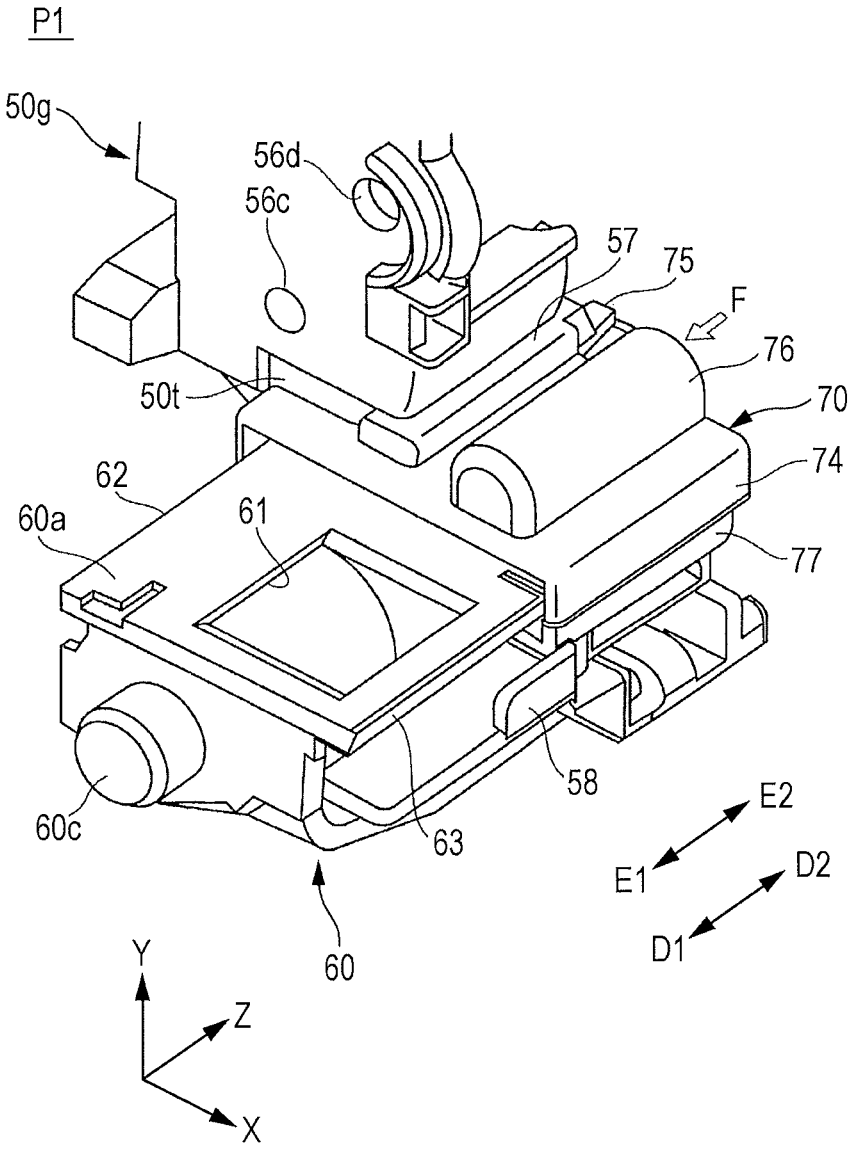
FIG. 13 is a schematic perspective view illustrating a state when the opening/closing shutter of the developing device shown in FIG. 4 is displaced to a position where the receiving opening is uncovered.

Accordingly, after each opening/closing shutter 70 has stably moved in the opening direction E2 along the top surface portion 60*a* of the corresponding supply receiving portion 60, referring to the bottom portion in FIGS. 13 and 14, each opening/closing shutter 70 reaches the position (P1) where the receiving opening 61 is uncovered.

At each removable unit 20 mounted on the corresponding mounting portion 13 of the image forming apparatus 1, when, for example, an image forming operation is performed, rotary power from a driving source at the side of the corresponding mounting portion 13 is transmitted to the photoconductor drum 21 and the developing roller 51 of the corresponding developing device 5, so that the photoconductor drum 21 and the developing roller 51 are rotationally driven.

Here, at the far side when each developing device 5 is mounted, in addition to a coupling operation between the drive-side coupling 55 at the side of the corresponding developing roller 51 and the driving-side coupling 16 at the side of the corresponding mounting portion 13 (that is, connection between the units for transferring rotary power therebetween), connection between the supply receiving portion 60 and the corresponding supply transport pipe 17 at the side of the corresponding mounting portion 13 (that is, connection between the units for transferring supply developer therebetween) is performed at the same time.

Therefore, operability of each developing device 5 when it is mounted on and dismounted from the corresponding mounting portion 13 is simple and good.

In each developing device 5, rotary power of the corresponding developing roller 51 transmitted by the coupling between the drive-side coupling 55 and the driving-side coupling 16 is transmitted to the screw augers 53 and 52 via the above-described gear train 56.

Therefore, in each developing device 5, compared to the case in which, for example, after rotary power from the mounting portion 13 has been transferred from one end of the developing roller, the rotary power of the developing roller is transmitted to the screw augers 53 and 52 via a gear train that is disposed at the other end portion of the developing roller, it is possible to reduce the generation of a load for transmitting the rotary power of the developing roller 51.

As shown in FIG. 3, the removable units 20Y, 20M, 20C, and 20K are principally removed by pulling out the removable units 20Y, 20M, 20C, and 20K while moving them along a pulling-out direction (indicated by arrow D2) from the predetermined portions of the respective mounting portions 13 of the image forming apparatus 1 with the end portion of each of the removable units 20Y, 20M, 20C, and 20K corresponding to the near side when each of the removable units 20Y, 20M, 20C, and 20K is mounted being a leading side.

During the removing operation, at the far side when each removable unit 20 is mounted, the shaft 214 of the corresponding photoconductor drum 21 is removed from the mounting hole 14 of the corresponding mounting portion 13, and the positioning protrusion 219 is removed from the positioning receiving hole 19 of the corresponding mounting portion 13.

During the removing operation, at the far side when each removable unit 20 is mounted, the connecting gear 215 of the corresponding photoconductor drum 21 is removed from the connecting driving gear 15 of the mounting portion 13, and the drive-side coupling 55 at the developing roller 51 of the corresponding developing device 5 is disconnected from the driving-side coupling 16 of the corresponding mounting portion 13.

Further, during the removing operation, at the far side when each removable unit 20 is mounted, the supply receiving portion 60 of the corresponding developing device 5 is separated from (the connecting components 18 at) the supply transport pipe 17 of the corresponding mounting portion 13.

Each supply receiving portion 60 and the corresponding supply transport pipe 17 at this time are separated from each other as follows.

That is, the supply receiving portion 60 of each developing device 5 is such that, first, when the far side of the corresponding removable unit 20 moves away from a far-side portion of the corresponding mounting portion 13, for example, the closed end portion 76*b* of the accommodating holding unit 76 of the corresponding opening/closing shutter 70 is brought out of contact with the connecting components 18 at the corresponding supply transport pipe 17. When each removable unit 20 is moved by being pulled out from the far-side portion of the corresponding mounting portion 13, the connecting components 18 at the corresponding supply transport pipe 17 are no longer in the state in which they push the corresponding opening/closing shutter 70 in the opening direction E2. By this, each opening/closing shutter 70 receives the spring force F of the corresponding coil spring 68, is guided so as to move in a straight line by the guiding portions 62 and 63 of the corresponding supply receiving portion 60, and is moved in the closing direction indicated by the arrow E1.

Even when each opening/closing shutter 70 is moved in the closing direction E1, due to the same reason mentioned above, the cutaway end portion 72 tends to move in the direction of arrow J, as a result of which each opening/closing shutter 70 may be placed in an unstable state in which it is raised from the top surface portion 60*a* of the corresponding supply receiving portion 60. However, even in this case, similarly to when the mounting operation is carried out, each extended protrusion 75 passes through the holding space S3 with each extended protrusion 75 being continuously kept in a state in which it is sandwiched in the holding space S3 formed between the sandwiching holding portion 57 and the top surface portion 60*a* of the corresponding supply receiving portion 60. Therefore, it is possible to restrict the aforementioned movement in the direction of arrow J and to stably move each opening/closing shutter 70 in the closing direction E1.

When, as mentioned above, the pushing of the closed end portion 76*b* of the corresponding accommodating holding unit (which is disposed closer to a certain side) as a result of contacting the connecting components 18 at the supply transport pipe 17 is no longer performed, referring to, for example, FIGS. 9 and 12, each end portion 70*b* (at the side where the cutaway end portion 72 does not exist) tends to move in the direction of arrow K, as a result of which each opening/closing shutter 70 may be placed in an unstable state in which it is raised from the top surface portion 60*a* of the corresponding supply receiving portion 60. However, even in this case, similarly to when the mounting operation is performed, in each opening/closing shutter 70, its end portion 70*b* (restriction portion 77) at the side where the cutaway end portion 72 does not exist contacts the restricting portion 58 at the supply transport pipe 17 to restrict the movement of the corresponding opening/closing shutter 70 in a direction crossing the movement directions E. Therefore, it is possible to restrict the aforementioned movement in the direction of arrow K and stably move each opening/closing shutter 70 in the opening direction E2.

In this way, after each opening/closing shutter 70 has stably moved in the closing direction E1 along the top surface portion 60*a* of the corresponding supply receiving portion 60, as shown in the top portion of FIG. 12 or FIG. 14, each opening/closing shutter 70 reaches the position (P2) where the corresponding receiving opening 61 is covered.

Other Exemplary Embodiments

In the first exemplary embodiment, the developing devices 5 are exemplified as being mountable on and dismountable from the mounting portions 13 by using the removable units 20 therefor as a result of an inserting operation and a removing operation. However, the developing devices 5 may be previously mounted on setting portions of the housing 10 and then a supply developer transport unit may be connected to each supply receiving portion 60. In this case, the supply receiving portion 60 of each developing device 5 may be disposed at a portion situated at a side where the supply developer transport unit is attached later.

In the first exemplary embodiment, in the opening/closing shutter 70 of each developing device 5, its extended protrusion 75 is formed so as to at least exist at a portion that is closer to the end portion 70*a* (at the side where the cutaway end portion 72 exists) than the center position Pc between the left end portion 70*a* and the right end portion 70*b* of the corresponding body 71. However, each opening/closing shutter 70 may be formed such that its extended protrusion 75 is formed in the aforementioned range and in a range in which it extends into a portion that is closer to the end portion 70*b* (at the side where the cutaway end portion 72 does not exist) than the center position Pc.

When each opening/closing shutter 70 is capable of moving stably, it is possible to omit the restricting portion 58.

Further, although, in the first exemplary embodiment, a portion of each gear cover 50*g* corresponds to the protruding portion 50*t* of the housing 50 of each developing device 5, each protruding portion is not limited thereto. Each protruding portion 50*t* may correspond to, for example, other portions of the corresponding housing 50.

In the first exemplary embodiment, as each developing device 5, a structure in which the gear train 56 that transmits rotary power of the developing roller 5 to the screw augers 52 and 53 is disposed at a portion (end portion) situated at the front-end side in the insertion direction D1 when the developing device 5 is mounted is exemplified. However, as each developing device 5, a structure in which the gear train 56 is disposed at a portion (end portion) at the leading end side in the insertion direction D2 when the developing device 5 is mounted may be used.

When the image forming apparatus to which the present invention is applied is an image forming apparatus that is capable of forming color images, a system that does not use an intermediate transfer device (that is, what is called a direct transfer type in which recording paper P is transported so as to pass the first transfer position at each image forming device and toner images are directly transferred to the recording paper) may be used. As the image forming apparatus to which the present invention is applied, an image forming apparatus that forms a single-color image such as a monochrome image may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a housing that includes an accommodating portion that accommodates developer, a development opening portion that is formed continuously with the accommodating portion, a developing roller that is rotatably disposed at a side of the accommodating portion with respect to the opening portion, and a supply receiving portion having a receiving opening that receives supply developer that is supplied to the accommodating portion;

an opening/closing member that is mounted on the supply receiving portion of the housing, the opening/closing member moving between a position where the receiving opening is uncovered and a position where the receiving opening is covered;

a guiding portion that is provided at the supply receiving portion of the housing, the guiding portion guiding movement of the opening/closing member; and an elastic pushing member that pushes the opening/closing member towards the position where the receiving opening is covered, wherein the opening/closing member includes a body, a guide portion, and an extended protrusion, the body having a cutaway end portion that is formed by cutting away a corner located at one of left and right end portions, the left and right end portions corresponding to left and right sides when the opening/closing member moves between the position where the receiving opening is uncovered and the position where the receiving opening is covered, the guide portion being provided at the left and right end portions of the body except where the cutaway end portion exists, the guide portion being guided by contacting the guiding portion so as to surround the guiding portion from an outer side thereof, the extended protrusion being formed by causing at least a portion of an end portion of the body to extend and protrude in an opening direction when the opening/closing member moves to the position where the receiving opening is uncovered, the end portion corresponding to a leading side in the opening direction, and wherein the housing is provided with a sandwiching holding portion that holds at least a portion of the extended protrusion of the opening/closing member by sandwiching at least the portion of the extended protrusion by the sandwiching holding portion and the supply receiving portion.

2. The developing device according to claim 1, wherein the cutaway end portion of the opening/closing member is disposed closer to a side of the one of the left and right end portions, which correspond to the left and right sides when the opening/closing member moves between the position where the receiving opening is uncovered and the position where the receiving opening is covered, of the body than a center position between the left and right end portions, and wherein the extended protrusion of the opening/closing member exists at least at a portion of an end portion of the body disposed closer to a side where the cutaway end portion exists than the center position between the left and right end portions of the body.

3. The developing device according to claim 1, further comprising a restricting portion that is provided at the supply receiving portion of the housing, the restricting portion contacting an end portion of the opening/closing member where the cutaway end portion does not exist from an outer side thereof and restricting movement of the opening/closing member in a direction that crosses a movement direction of the opening/closing member.

4. The developing device according to claim 1, wherein the housing further includes a protruding portion that protrudes towards the supply receiving portion so as to become an obstacle when the opening/closing member moves to the position where the receiving opening is uncovered, and wherein the cutaway end portion of the opening/closing member has a shape that does not allow the opening/closing member to exist at the protruding portion.

5. The developing device according to claim 1, wherein the developing device is capable of being mounted on and dismounted from a mounting portion for the developing device by an inserting operation and a removing operation, respectively, and wherein the supply receiving portion of the housing is disposed at a portion at a leading end side in an insertion direction of the developing device into the mounting portion and is formed so as to be connected to a supply developer transport unit that exists at the mounting portion.

6. The developing device according to claim 5, wherein the developing roller is formed such that rotary power is transmitted to a rotation transmitting member, which exists at the mounting portion, via a shaft coupling at the leading end side in the insertion direction, and wherein the housing further includes a stirring transport member and a rotation transmitting mechanism, the stirring transport member being rotatably disposed so as to stir the developer in the accommodating portion and transport the developer towards the developing roller, the rotation transmitting mechanism being disposed at a portion at the leading end side in the insertion direction and transmitting the rotary power of the developing roller to the stirring transport member.

7. An image forming apparatus comprising:

the developing device according to claim 1.

8. The image forming apparatus according to claim 7, further comprising a mounting portion on which the developing device is capable of being mounted and from which the developing device is capable of being dismounted by an inserting operation and a removing operation, respectively, wherein a supply developer transport unit that is connected to the supply receiving portion of the developing device is disposed at a portion of the mounting portion at a far side in an insertion direction of the developing device.

9. The image forming apparatus according to claim 8, wherein a rotation transmitting member that transmits rotary power to the developing roller of the developing device via a shaft coupling is disposed at a portion of the mounting portion at the far side in the insertion direction.

* * * * *